US010054386B2

(12) United States Patent
Houle

(10) Patent No.: US 10,054,386 B2
(45) Date of Patent: Aug. 21, 2018

(54) ROPE COCKER FOR CROSSBOW

(71) Applicant: PLACEMENTS GASTON HOULE INC., Wickham (CA)

(72) Inventor: Gaston Houle, Wickham (CA)

(73) Assignee: PLACEMENTS GASTON HOULE INC., Wickham (QC) (CA)

( * ) Notice: Subject to any disclaimer, the term of this patent is extended or adjusted under 35 U.S.C. 154(b) by 0 days.

(21) Appl. No.: 15/646,539

(22) Filed: Jul. 11, 2017

(65) Prior Publication Data

US 2017/0307324 A1 Oct. 26, 2017

Related U.S. Application Data

(63) Continuation of application No. 15/199,007, filed on Jun. 30, 2016, now Pat. No. 9,797,676.

(60) Provisional application No. 62/188,516, filed on Jul. 3, 2015.

(51) Int. Cl.
*F41B 5/12* (2006.01)
*F41B 5/14* (2006.01)

(52) U.S. Cl.
CPC ..... *F41B 5/1469* (2013.01); *F41B 5/12* (2013.01)

(58) Field of Classification Search
CPC ..... F41B 5/12; F41B 5/123
See application file for complete search history.

(56) References Cited

U.S. PATENT DOCUMENTS

| | | | |
|---|---|---|---|
| 4,854,293 | A | 8/1989 | Roberts |
| 4,926,834 | A | 5/1990 | Chauvin |
| 5,243,956 | A | 9/1993 | Luehring |
| 6,554,778 | B1 | 4/2003 | Fleming, III |
| 7,624,725 | B1 | 12/2009 | Choma |
| 7,891,053 | B2 | 2/2011 | Schuelke |
| D647,157 | S | 10/2011 | Errett |
| 8,439,024 | B2 | 5/2013 | Barnett |
| 8,573,192 | B2 | 11/2013 | Bednar |
| 9,285,182 | B2 | 3/2016 | Bednar |
| 9,383,159 | B2 | 7/2016 | Pulkrabek |
| 9,423,203 | B2 | 8/2016 | Simonds |
| 2010/0011535 | A1 | 1/2010 | Schuelke |
| 2011/0232619 | A1 | 9/2011 | Bednar |
| 2012/0037139 | A1 | 2/2012 | Barnett |
| 2014/0069403 | A1 | 3/2014 | Simonds |
| 2014/0261360 | A1 | 9/2014 | Pulkrabek |
| 2015/0013654 | A1 | 1/2015 | Bednar |

OTHER PUBLICATIONS

Parker Rope Cocker Illustration, published Dec. 11, 2014.

(Continued)

*Primary Examiner* — John Ricci

(74) *Attorney, Agent, or Firm* — Mathieu Audet

(57) ABSTRACT

A cocker mechanism for cocking a string of a crossbow is presented, the cocker mechanism comprising a rope, a pair of handles secured to respective ends of the rope and a pair of string connectors operatively secured by the rope between the pair of handles, the string connector comprising a body, a rope-connecting portion including a bearing member rotatably secured to the body about a axle and a bearing member rotation axis thereof for supporting pressure and translational movements of the rope thereon, a string-connecting portion for securing the string of the crossbow when cocking the crossbow. A kit thereof and a method of use thereof are concurrently presented.

20 Claims, 29 Drawing Sheets

(56) References Cited

OTHER PUBLICATIONS

E-Z Find Crossbow Rope Cocker, published May 21, 2015.
Killer Instinct Rope Cocking Device, published Dec. 11, 2014.
Desert Stryker rope cocker, published Dec. 11, 2014.
Rope Cocker Illustration, published Dec. 11, 2014.

ROPE COCKER FOR CROSSBOW

CROSS-REFERENCES

The present application relates to, is a continuation of and claims priority from U.S. patent application Ser. No. 15/199,007, filed Jun. 30, 2016, entitled ROPE COCKER FOR CROSSBOW AND METHOD OF USE THEREOF, that relates to, is a non-provisional application of, and claims priority under 35 U.S.C. 119(e) to, U.S. provisional patent application No. 62/188,516 filed Jul. 3, 2015, entitled ROPE COCKER, filed under 35 U.S.C. 111(b), which is incorporated herein by reference in its entirety.

BACKGROUND OF THE INVENTION

1. Field of the Invention

This invention generally relates to crossbow improvements. The present invention more specifically relates to a rope cocker used in conjunction with a crossbow for cocking a string thereof to arm the crossbow.

2. Description of the Related Art

Crossbows are known since a long time as, originally, a war tool and, later, an alternative to guns for hunting and recreation shooting. Crossbows are designed to pretense a string thereof and install an arrow on the crossbow in a position ready to shoot. The crossbow configuration includes a stirrup at a longitudinal distal end of a body thereof, along which the arrow is propelled by the string. The crossbow is generally heading down resting on its stirrup in contact with the ground to receive a foot therein to firmly maintain the crossbow to the ground in opposition to the tension required to proximally pull the string, generally by hand power or with a mechanism facilitating the cocking, to cock the string. The string is then locked in a position adapted to longitudinally propel the arrow when the tension in the string is selectively released.

The cocking mechanism generally uses a force-multiplicating mechanism providing the user with a mechanical advantage; the amount of input effort is multiplied to exercise greater forces on the string. The force-multiplicating mechanism is generally embodied including a pair of bearing elements and a rope. The user can thus manually cock a string with significant tension therein that would otherwise be difficult or impossible to cock manually without the force-multiplicating mechanism. Put differently, the force-multiplicating mechanism divides the strength required to cock the string of the crossbow.

Rope cocker mechanisms found in the art are not ergonomically optimized and might be a challenge to use for some people. Friction of the rope cocker on the bearing element also adds to the strength required to cock the string in addition to cause abrupt displacements of the rope cocker mechanism when the bearing elements are repositioning while the string moves to reach its tensed position.

Direct contact between the string and the force-multiplicating mechanism can generate undesirable noise detrimental to successful hunting.

Configuration of prior art rope cocker mechanisms are requiring friction between the rope cocker mechanism and the crossbow, the friction reduces the efficiency of the mechanism and might damage the crossbow.

It is therefore desirable to provide an improved rope cocker mechanism over the existing art that is easier and more efficient to use.

It is desirable to provide an improved rope cocker mechanism that is reducing operating friction between the different components thereof.

It is also desirable to provide an improved rope cocker mechanism over the existing art that provides a more harmonious interaction with the crossbow.

It is desirable to provide a rope cocker mechanism that is easy to manufacture.

Other deficiencies will become apparent to one skilled in the art to which the invention pertains in view of the following summary and detailed description with its appended figures.

SUMMARY OF THE INVENTION

One aspect of the present invention is alleviating one or more of the shortcomings of the background art by addressing one or more of the existing needs in the art.

The following presents a simplified summary of the invention in order to provide a basic understanding of some aspects of the invention. This summary is not an extensive overview of the invention. It is not intended to identify key/critical elements of the invention or to delineate the scope of the invention. Its sole purpose is to present some concepts of the invention in a simplified form as a prelude to the more detailed description that is presented later.

The invention is generally described as rope cocker mechanism adapted to more easily cock a string of a crossbow and other improvements thereof.

Aspects of our work, in accordance with at least one embodiment thereof, provide a rope cocker mechanism including an asymmetrical string connector.

Aspects of our work, in accordance with at least one embodiment thereof, provide a rope cocker mechanism including a pair of mirrored string connectors including a pair of mirrored right-left string connectors.

Aspects of our work, in accordance with at least one embodiment thereof, provide a string connector accommodating a pair of pulleys, a first pulley being designed to support movements and change of directions of the rope along a portion of its circumference and a second pulley being designed to support movements and change of directions of the string of the crossbow along a portion of its circumference.

Aspects of our work, in accordance with at least one embodiment thereof, provide a rope cocker mechanism that is self-repositioning along the string when installed in an operating position on the crossbow.

Aspects of our work, in accordance with at least one embodiment thereof, provide a string connector including thereof a first pulley and second pulley in closer relationship with each other.

Aspects of our work, in accordance with at least one embodiment thereof, provide a string connector including a first pulley adapted to operatively connect with the rope of the rope cocker mechanism and a second pulley adapted to operatively connect the string of the crossbow.

Aspects of our work, in accordance with at least one embodiment thereof, provide a string connector locating including a pair of pulleys adapted to reduce friction and facilitate the positioning of the string connector in an operating position in respect with the body of the crossbow.

Aspects of our work, in accordance with at least one embodiment thereof, provide a string connector locating a first pulley coplanar with a second pulley.

Aspects of our work, in accordance with at least one embodiment thereof, provide a string connector locating a first axis of the first pulley coaxial in the longitudinal direction with a second axis of the second pulley.

Aspects of our work, in accordance with at least one embodiment thereof, provide a string connector locating a first pulley having an offset transversal alignment with a second pulley when installed in an operating configuration.

Aspects of our work, in accordance with at least one embodiment thereof, provide a string connector including a first pulley coplanar and co-axial with a second pulley.

Aspects of our work, in accordance with at least one embodiment thereof, provide a rope cocker mechanism including two string connectors sized and designed to remain substantially parallel with each other upon actuation of the rope cocker mechanism for cocking the string of the crossbow.

Aspects of our work, in accordance with at least one embodiment thereof, provide a rope cocker mechanism including two string connectors sized and designed to minimize contact with the body of the crossbow upon actuation of the rope cocker mechanism for cocking the string of the crossbow.

Aspects of our work, in accordance with at least one embodiment thereof, provide a rope cocker mechanism including two string connectors sized and designed to use the rope of the rope cocker mechanism to contact with the body of the crossbow upon actuation of the rope cocker mechanism when cocking the string of the crossbow.

Aspects of our work, in accordance with at least one embodiment thereof, provide string connectors including a string-engaging portion sized and designed to retain the string of the crossbow therein in a fashion preventing the string to disengage from the string-engaging portion when tension in the string is not sufficient to keep the string engaged in the string-engaging portion.

Aspects of our work, in accordance with at least one embodiment thereof, provide a string connector including a reinforcing rope guard adapted to interconnect two sides of the string connector.

Aspects of our work, in accordance with at least one embodiment thereof, provide a string connector including a pair of reinforcing rope guards adapted to interconnect two sides of the string connector about the first pulley and maintain the rope next to the first pulley.

Aspects of our work, in accordance with at least one embodiment thereof, provide a string connector including a reinforcing rope guard adapted to abut a handle thereon when the rope cocker mechanism is installed on the crossbow in an operating position before cocking the string.

Aspects of our work, in accordance with at least one embodiment thereof, provide a string connector including a pair of pulleys including a brass wheel and a stainless steel axel.

Aspects of our work, in accordance with at least one embodiment thereof, provide a string connector including a pair of pulleys including a polymer wheel and a metallic axis.

Aspects of our work, in accordance with at least one embodiment thereof, provide a string connector sized and designed to be molded in polymer and including a design allowing a symmetrical flow of polymer in the mold to improve the material distribution of the polymer forming the string connector.

Aspects of our work, in accordance with at least one embodiment thereof, provide a rope cocker including a plurality of lower pulleys.

Aspects of our work, in accordance with at least one embodiment thereof, provide a rope cocker including a single upper pulley and a lower pulleyless bearing portion.

Aspects of our work, in accordance with at least one embodiment thereof, provide a rope cocker kit including a pair of string connectors, a rope and a pair of handles.

Aspects of our work, in accordance with at least one embodiment thereof, provide a rope cocker including a pair of string connectors adapted to abut thereon a pair of handles when the rope cocker is installed on a crossbow in an operating configuration.

Each of the embodiments of the present invention has at least one of the above-mentioned objects and/or aspects, but does not necessarily have all of them. It should be understood that some aspects of the present invention that have resulted from attempting to attain the above-mentioned objects may not satisfy these objects and/or may satisfy other objects not specifically recited herein.

Additional and/or alternative features, aspects, and advantages of embodiments of the present invention will become apparent from the following description, the accompanying drawings, and the appended claims.

DESCRIPTION OF EMBODIMENT(S) OF THE INVENTION

Our work is now described with reference to the figures. In the following description, for purposes of explanations, numerous specific details are set forth in order to provide a thorough understanding of the present invention by way of embodiment(s). It may be evident, however, that the present invention may be practiced without these specific details.

Figure 1:
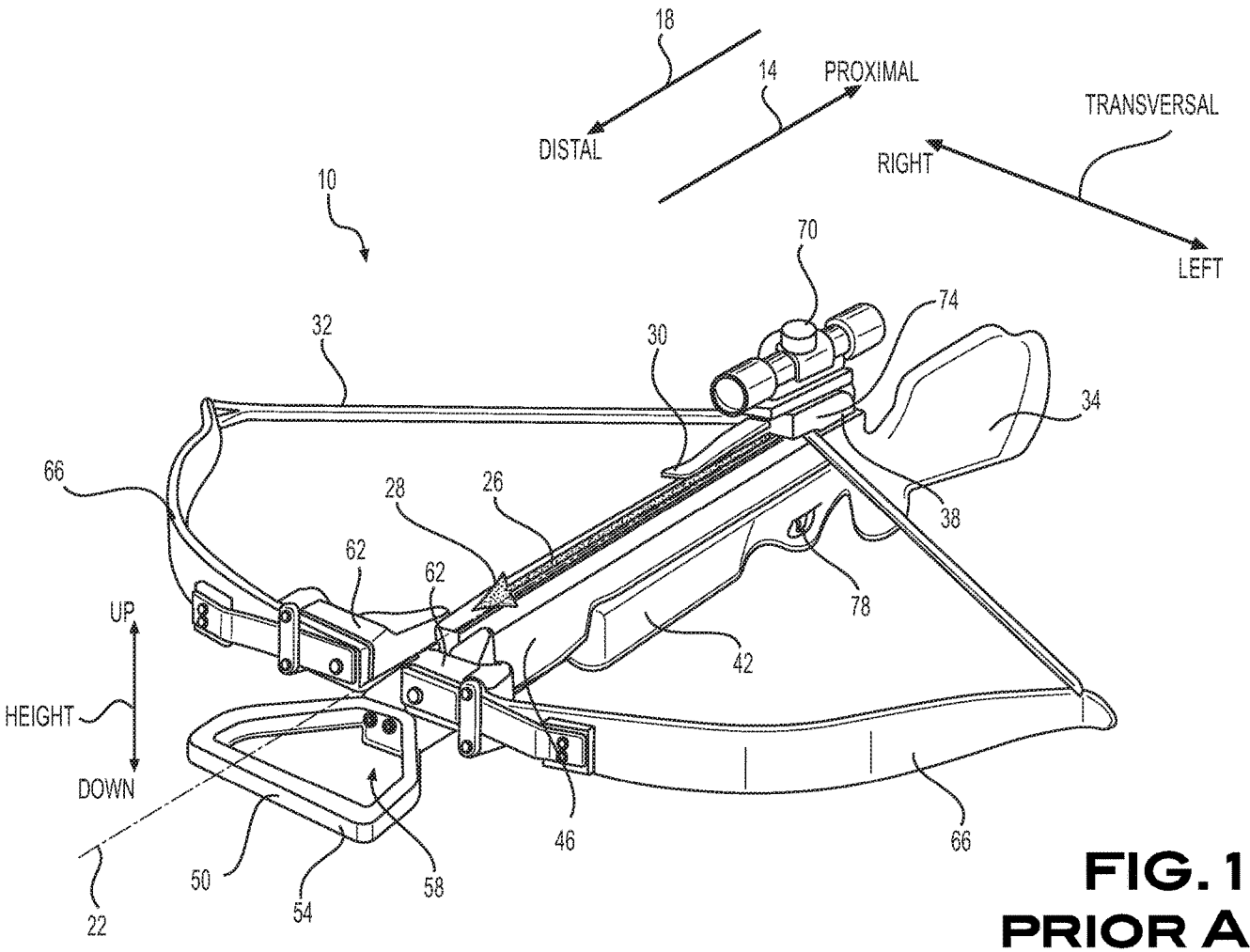
FIG. 1 PRIOR ART
FIG. 1 is an illustration of a prior art crossbow.

A crossbow 10 is illustrated in FIG. 1, the crossbow 10 includes a side proximal 14 to the user and a side distal 18 to the user 90 when the crossbow 10 is held by a user in a shooting position. The crossbow 10 includes a longitudinal axis 22 along which an arrow 26 and its broadhead 28, when properly installed on the crossbow 10 in its flight groove and optionally held by an arrow retention spring 30, is properly located to be propelled by a string 32. The crossbow 10 further comprises a stock 34, a sight bridge 38, a foregrip 42 and a barrel 46 that can also be referred to as a longitudinal frame or a longitudinal body. On its distal 18 end, the crossbow 10 includes a stirrup 50 disposed thereon. The stirrup 50 includes a frame 54, generally aligned with the longitudinal axis 22, and a foot-receiving portion 58 disposed therein. The stirrup 50 is configured to help the user 90 of the crossbow to cock the string 32 to accumulate tension therein to be selectively released to propel the arrow 26. Generally, the distal 18 end of the crossbow 10 is put on the ground, the user 90 puts a foot inside the stirrup 50 and holds the stirrup 50 on the ground with a foot pressure against the tensing string 32. As illustrated, the stirrup 50 is fastened to the distal end 18 of the barrel 46 next to the riser 62 to which are connected a pair of limbs 66 on respective transversal side thereof. The pair of limbs 66 is adapted to be flexed to accumulate energy that is selectively released to propel the arrow 26 with the string 32. The crossbow 10 is further equipped with an optional sight 70 and a latch 74 holds the tensed string 32 that can be selectively activated to release the string 32 and propel the arrow 26 upon actuation of the trigger 78 by the user 90.

Figure 2:
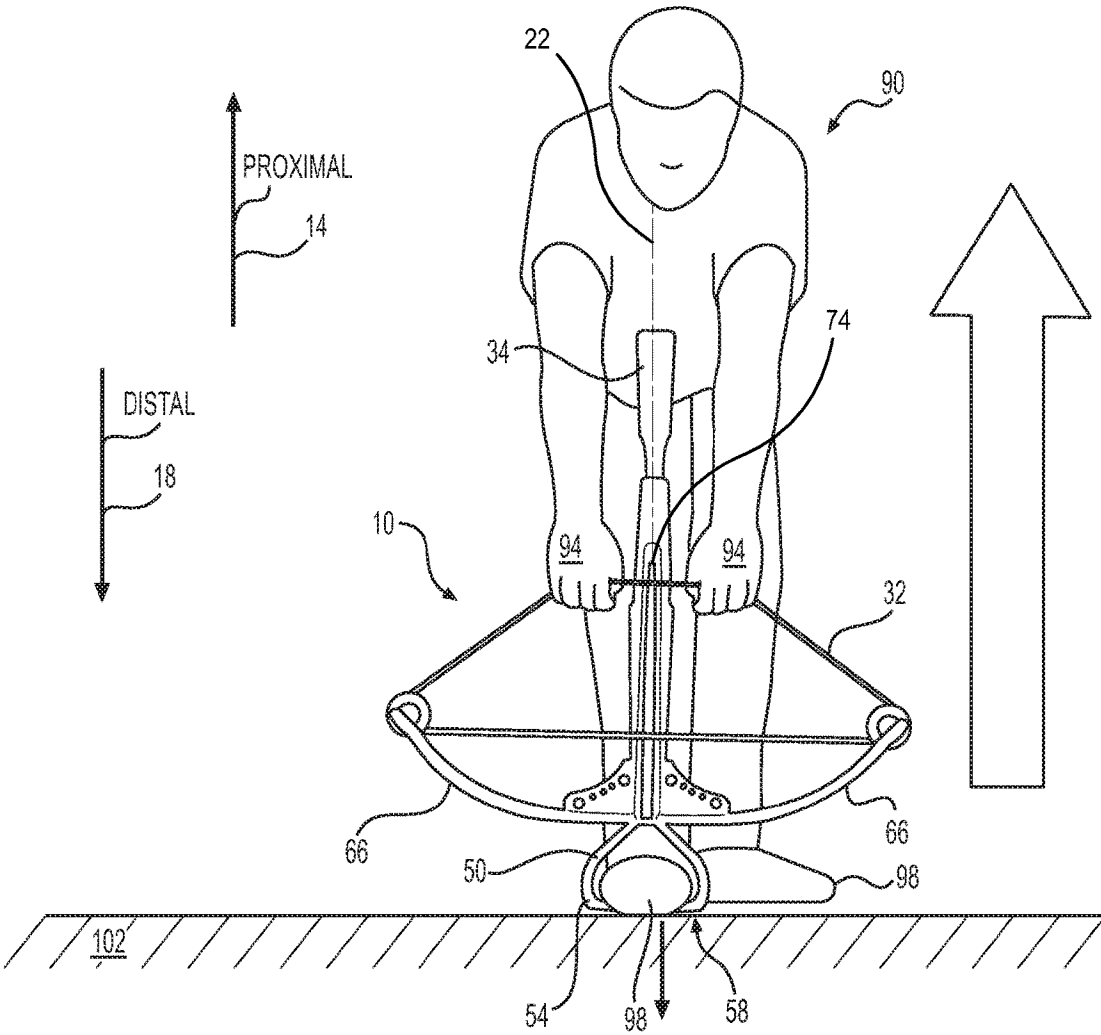
FIG. 2 PRIOR ART
FIG. 2 is a schematic illustration of a person manually cocking a crossbow.

Turning now to FIG. 2 illustrating a typical cocking by hand of a crossbow 10 with a user 90 using his/her hands 94 to pull the string 32 toward the proximal side 14 of the crossbow 10. Simultaneously, the user 90 is using one foot 98 inside the stirrup 50 to apply pressure distally 18 toward the ground 102 to maintain the crossbow 10 on the ground 102 and counterbalance the tension applied proximally 14 to the string 32 to cock the crossbow 10.

Figure 3:
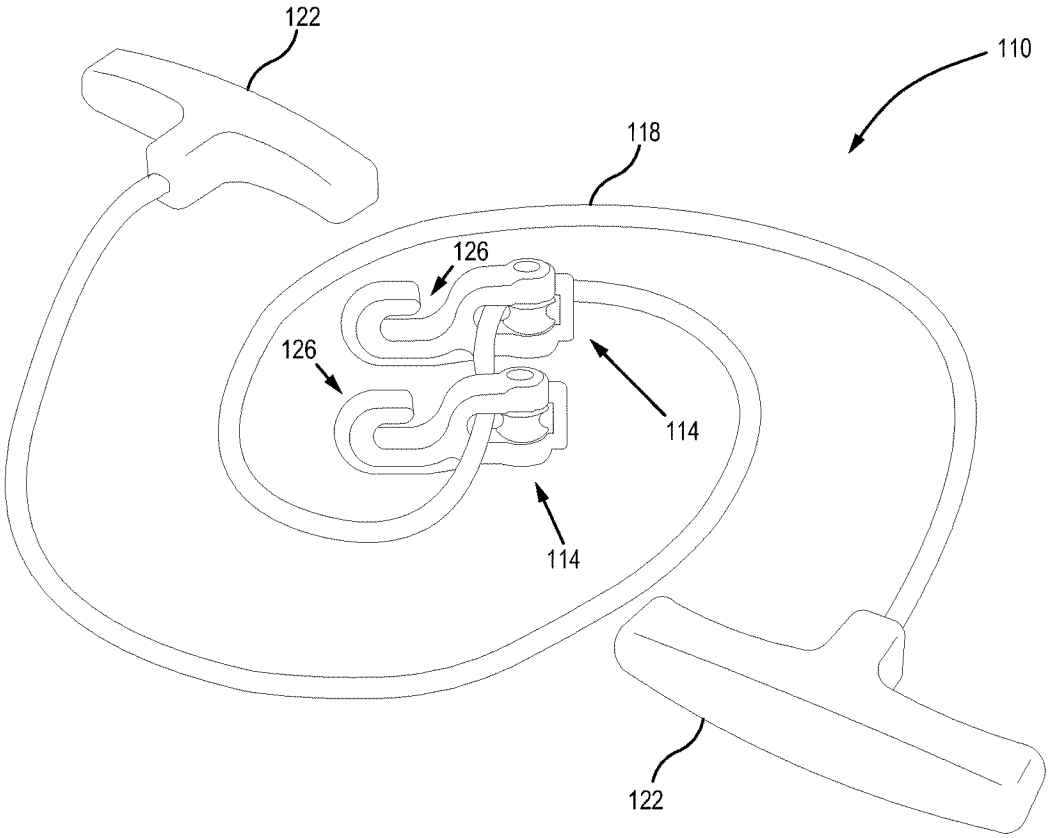
FIG. 3 PRIOR ART
FIG. 3 is depicting a prior art rope cocker mechanism.
Figure 4:
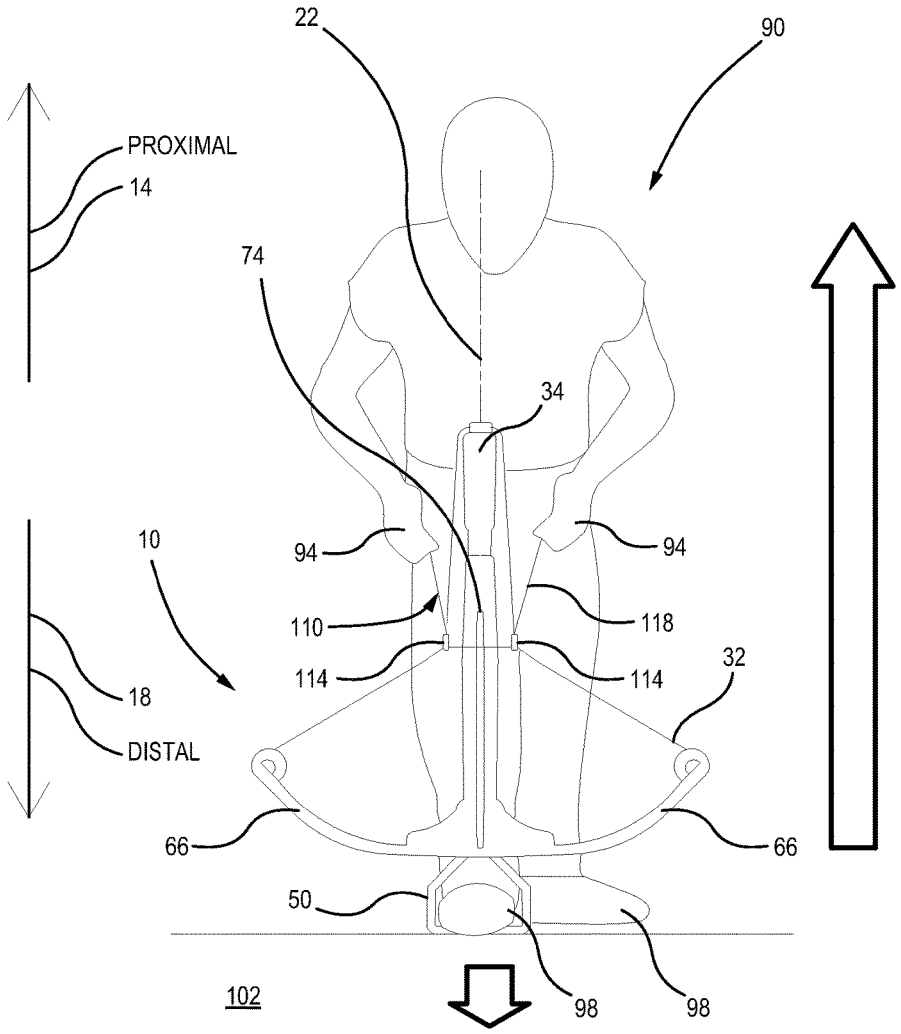
FIG. 4 is a schematic illustration of a person cocking a crossbow with a rope cocker mechanism.
Figure 5:
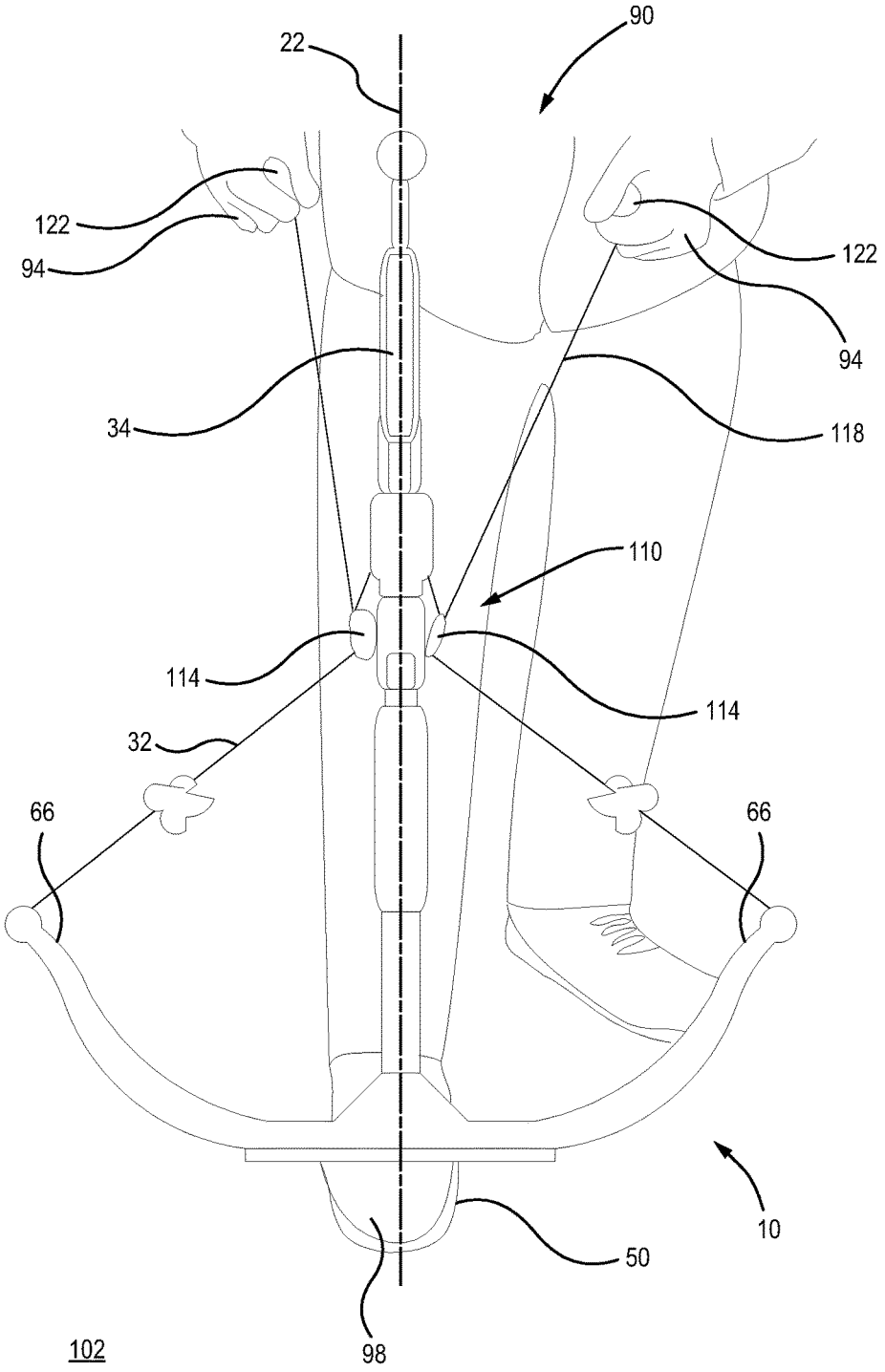
FIG. 5 is a schematic illustration of a person cocking a crossbow with a rope cocker mechanism.

FIG. 3 illustrates a prior art rope cocker mechanism 110 including a pair of handles 122 interconnected with a rope 118. A pair of string connectors 114 is operatively connected with the rope 118. As depicted in FIG. 4 and FIG. 5, a user 90 installed the rope 118 on a portion of the stock 34, or another fixed part of the crossbow 10, and secured hooks 126 of the string connectors 114 to the string 32 of the crossbow 10. Once the rope 118 is in proper contact with the crossbow 10 to get proper leverage and the hooks 126 of the string connectors 114 are connected to the string 32, the user 90 grasps the handles 122 with both hands 94 and pulls the handles 122 proximally to pull the string 32 and bend the limbs 66 hence accumulating energy therein. Tension in the string 32 is maintained by securing the string 32 with a latch 74. The energy stored in the limbs 66 is selectively released with actuation of the trigger 78 that releases the latch 74 and propels the string 32. One can appreciate from FIG. 4 and FIG. 5 that the user 90 pulls on the handles 122 of the rope cocker 110 with the arms and the upper back of the body. More strength is generally provided by the upper back than the arms. Hence, the length of the rope cocker 110 is significant for the ergonomics of crossbow 10 cocking to prevent using the arms as much as possible.

Figure 6:
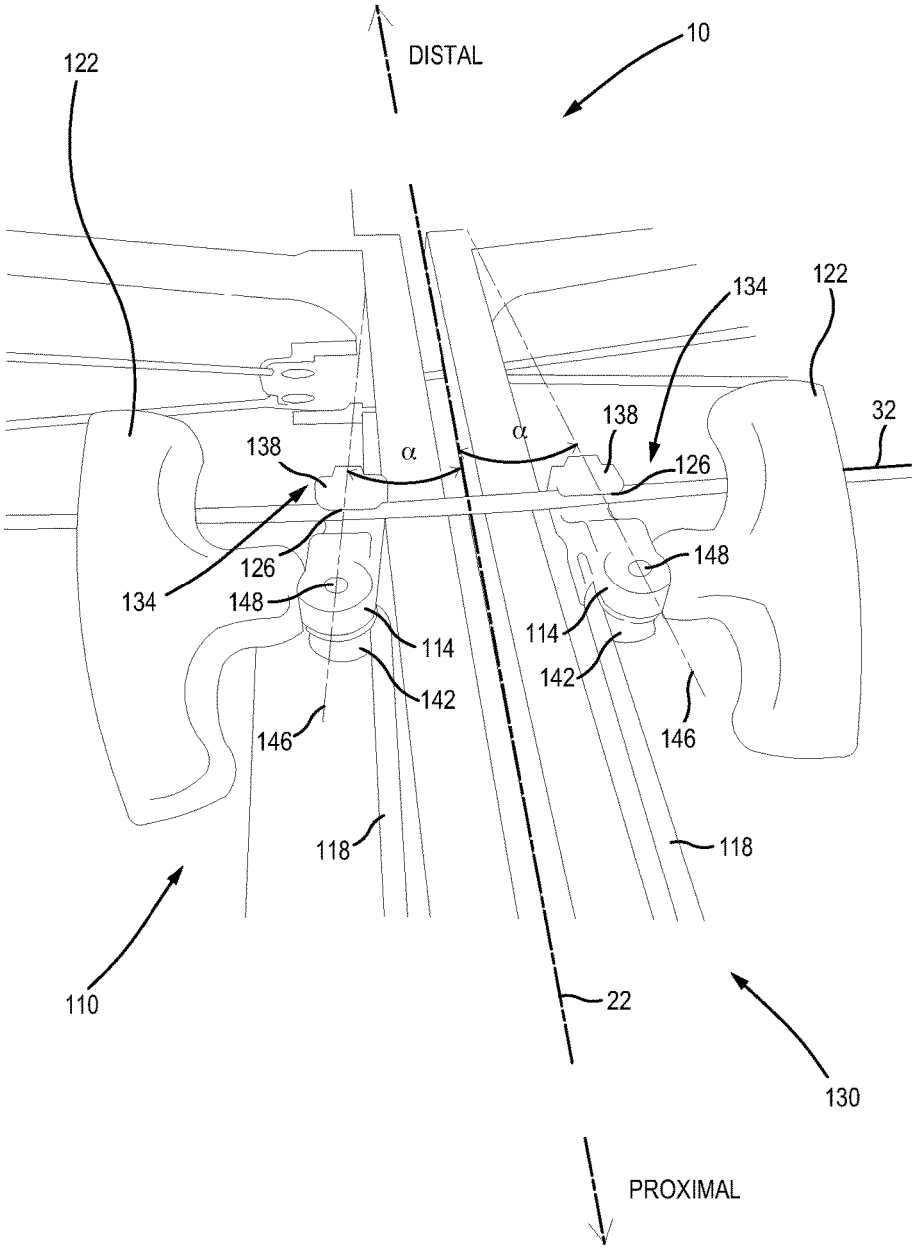
FIG. 6 PRIOR ART
FIG. 6 is an illustration of a prior art rope cocker operatively installed on a crossbow.

FIG. 6 depicts a portion of a crossbow 10 with a prior art rope cocker 110 operatively secured thereon in a first position 130 before cocking the string 32. A distal side 134 of the string connector 114 includes a hook portion 138 engaged with the string 32. A proximal side of the prior art rope cocker 110 includes a pulley 142 secured with an axle 148 and adapted to rotate about the axle 148 when the handles 122 are pulled to cock the string 32. Generally, the length of the rope 118 and the design of the prior art rope cocker 110 result in a slight tension in the string 32 when the prior art rope cocker 110 is operatively installed on the crossbow 10, at rest, prior to cocking the string 32. On can appreciate the string connectors 114 in their operating positions are not parallel in respect with the longitudinal axis 22 of the crossbow 10. The hook portion 138 is biased toward the longitudinal axis 22 of the crossbow 10 by the tension in the rope 118 of the prior art rope cocker 110. Each hook portion 138 is contacting directly the rope 118 and the barrel 46 of the crossbow 10. The hook portion 138 is going to rub the barrel 46 of the crossbow 10 when cocking the string 32. The design of the prior art rope cocker 110 results in an angled position of the string connectors 114 as identified by the angle α between each of the string connector axis 146 and the longitudinal axis 22 of the barrel 46.

Figure 7:
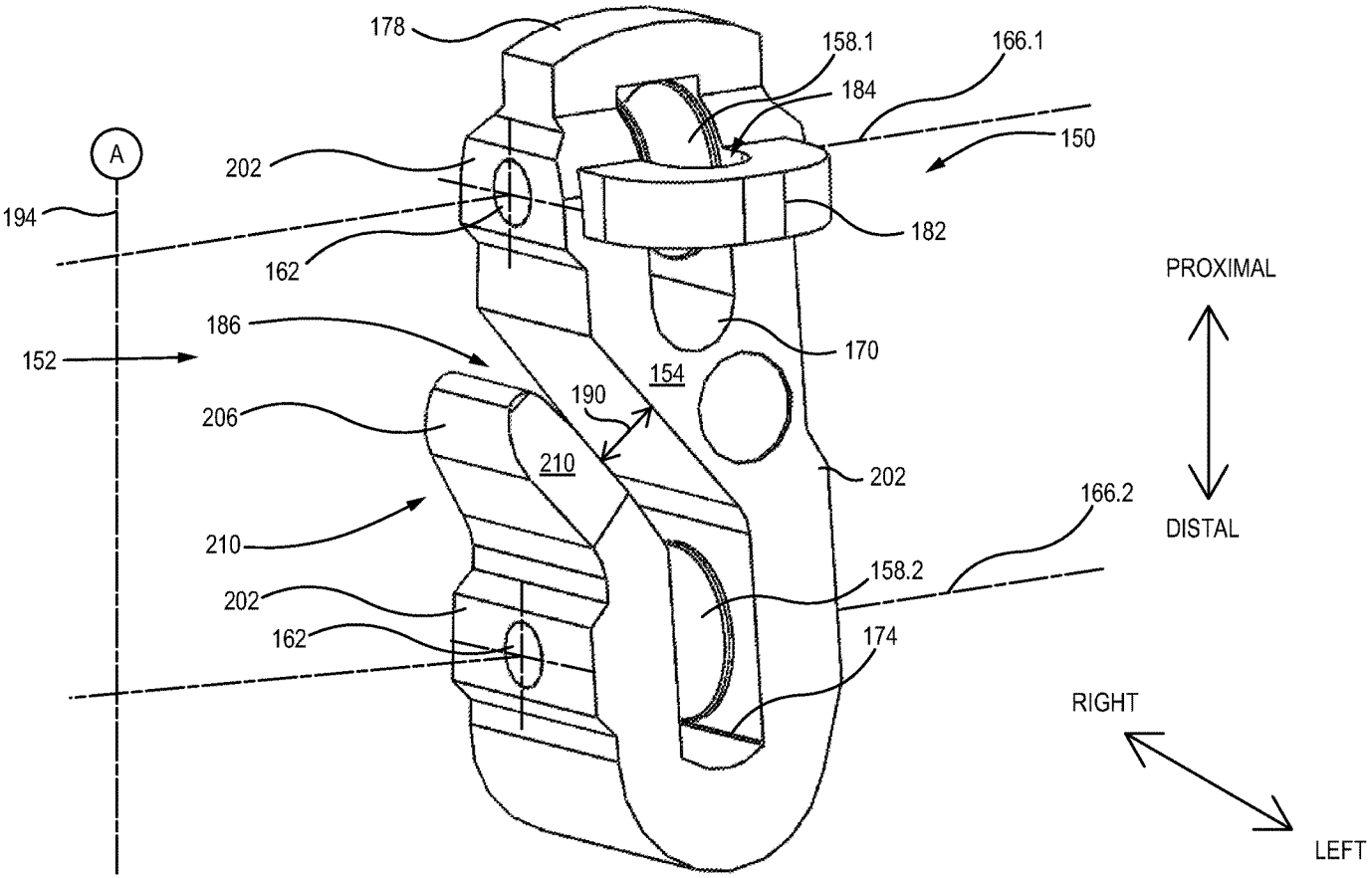
FIG. 7 is a front left elevation view of a string connector in accordance with an embodiment of the present invention.
Figure 8:
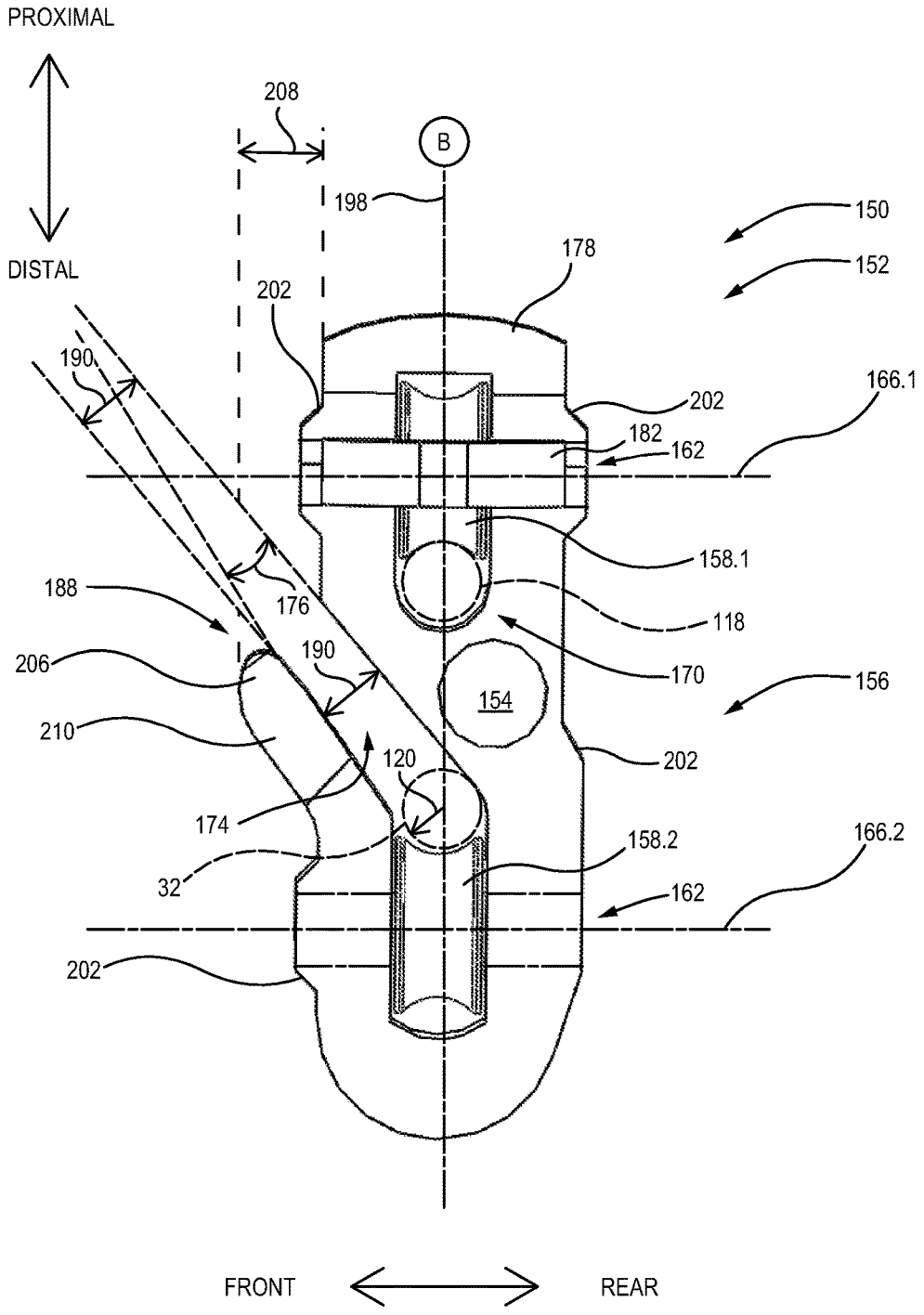
FIG. 8 is a left elevation view of a string connector in accordance with an embodiment of the present invention.

An embodiment of a string connector 150 in accordance with the present invention is illustrated in FIG. 7 and FIG. 8. The string connector 150 includes a body 154 comprising a rope-connecting portion 152 at a proximal side thereof and a string connecting portion 156 at a lower portion of the body, or at a distal side thereof. The body 154 is accommodating a pair of bearing members 158.1, 158.2 rotatably secured to the string connector 150 with respective axles 162 for rotating about bearing member axis 166.1, 166.2. Each bearing member 158.1, 158.2 is rotatably mounted to the body 154 to create a pulley with, respectively, the rope 118 and the string 32. The pair of bearing members 158 are substantially reducing the friction with the rope 118 and the string 32 that allows self-aligning of the string connectors 150 along the rope 118 and the string 32. The bearing members 158 can be embodied in copper or polymer materials with an outside shape preferably adapted to generally match a diameter of the rope 118. Each of the axles 162 can be embodied as a stainless steel rod press fitted in the body 154 of the string connector 150. The rod can be knurled over a portion of its length to ensure proper fit and securization in the body 154. Preferably, the axles 162 have a length substantially equivalent to the thickness of the body 154 to be flush on both sides of the body 154 when secured in the body 154 of the string connector 150. One can appreciate from FIG. 8 and FIG. 9 that the illustrated body 154 includes a front surface 160 and a rear surface 164 thereof. The body 154 is illustrated with sharp edges, however, a body 154 including radiuses is going to become obvious for a skilled reader as it is illustrated in other figures and remain within the scope of the present patent application.

The body 154 of the string connector 150 includes a proximal opening 170, adapted to house the proximal bearing member 158.1 therein, adapted to operatively connect the rope 118 of the crossbow 10, and a distal opening 174 adapted to house the distal bearing member 158.2 therein adapted to operatively connect a string 32 of the crossbow 10. The pair of bearing members 158 on each of the string connector 150 reduces friction between the string connector 150, the rope 118 and the string 32 when actuating the rope cocker mechanism 110.

The bearing members 158 are exemplified with a circular shape having a radial radius 120 preferably sized and designed to substantially match the diameter of the rope 118. The distal bearing member 158.2 could have a smaller radial radius 120 should the diameter of the string 32 be smaller. The radial radius 120 of both bearing members 158.1, 158.2 are embodied the same for illustrating purpose and for standardizing the bearing member 158 without intending to limit the scope of the present application to the illustrated embodiment. The bearing members 158 are exemplified with a similar diameter and could alternatively be embodied with different diameters to optimize the radius of curvature to the specification of the rope 118 and the string 32. The diameter of the illustrated bearing member 158 is about twelve millimeters (12 mm). Their respective bearing member axis 166.1, 166.2 are spaced apart in the proximal-distal direction of at least a distance corresponding to about one-and-a-half time the diameter of the bearing member 158. An alternate embodiment could use a distance of about between one-and-a-half time and two times the diameter of the bearing member 158. The illustrated embodiment uses a distance between about two times and two and a half times the diameter of the bearing member 158. Another alternate embodiment could use a distance of about between one-and-a-half time to two-and-a-half times the diameter of the bearing member 158. The proximal bearing member 158.1 and the distal bearing member 158.2 are aligned in two planes A and B; a first alignment 194 along plane A and a second alignment 198 along plane B. Both planes A and B are preferably orthogonal to each other as illustrated in the embodiment. The proximal opening 170 is bordered by two bridge supports, a proximal bridge support 178 and a side bridge support 182. The purpose of the bridge supports 178, 182 is generally to join and to reinforce the two opposed portions of the body 154 that are disposed on both sides of the bearing member 158.1. A second optional bridge support could be added to the body 154 of the string connector 150 over the second bearing member 158.2.

The bridge supports 178, 182 also help locate and position the rope 118 engaged in a rope receiver 184 and the handle 122, not illustrated in FIG. 7 and FIG. 8; this feature is going to be discussed in greater details in the specification below mainly in reference with FIG. 13. The width of the proximal opening 170 is sized and designed to receive therein the bearing member 158.1 with enough play to allow free rotation of the bearing member 158.1 therein and displacement of the rope 118, not illustrated in FIG. 7 and FIG. 8. The distal opening 174 is sized and designed to receive therein the bearing member 158.2 with enough play to allow free rotation of the bearing member 158.2 therein and displacement of the string 32 of the crossbow 10, not illustrated in FIG. 7 and FIG. 8. The distal opening 174 is closed by the body 154 on a distal side and opened 186 on the proximal side to receive therein the string 32 of the crossbow 10.

The distal opening 174 is angled 176 to exceed the body 154 to facilitate the insertion of the string 32 therein. The width 190 of the distal opening 174, that is embodied between 4 mm and 6 mm and more preferably about 5.3 mm, is optionally sized smaller than the diameter of the string 32 to allow insertion of the string 32 in the distal opening 174. A string-engaging portion 188 is hence embodied to slightly capture the string 32 therein to prevent the string 32 to come out from the distal opening 174 against the user's desire. The string connector 150 further includes reinforced areas 202 including more material to sustain mechanical higher loads. The reinforced areas 202 are sized and are located in accordance with the specific stresses applied on the string connector 150. The distal opening 174 includes an elongated hook portion 206 extending 208 further in front of the string connector 150 to facilitate the engagement therein of the string 32. Engagement of the string 32 in the hook portion 206 is facilitated by narrowing the edges 210 of the hook portion 206.

Figure 9:
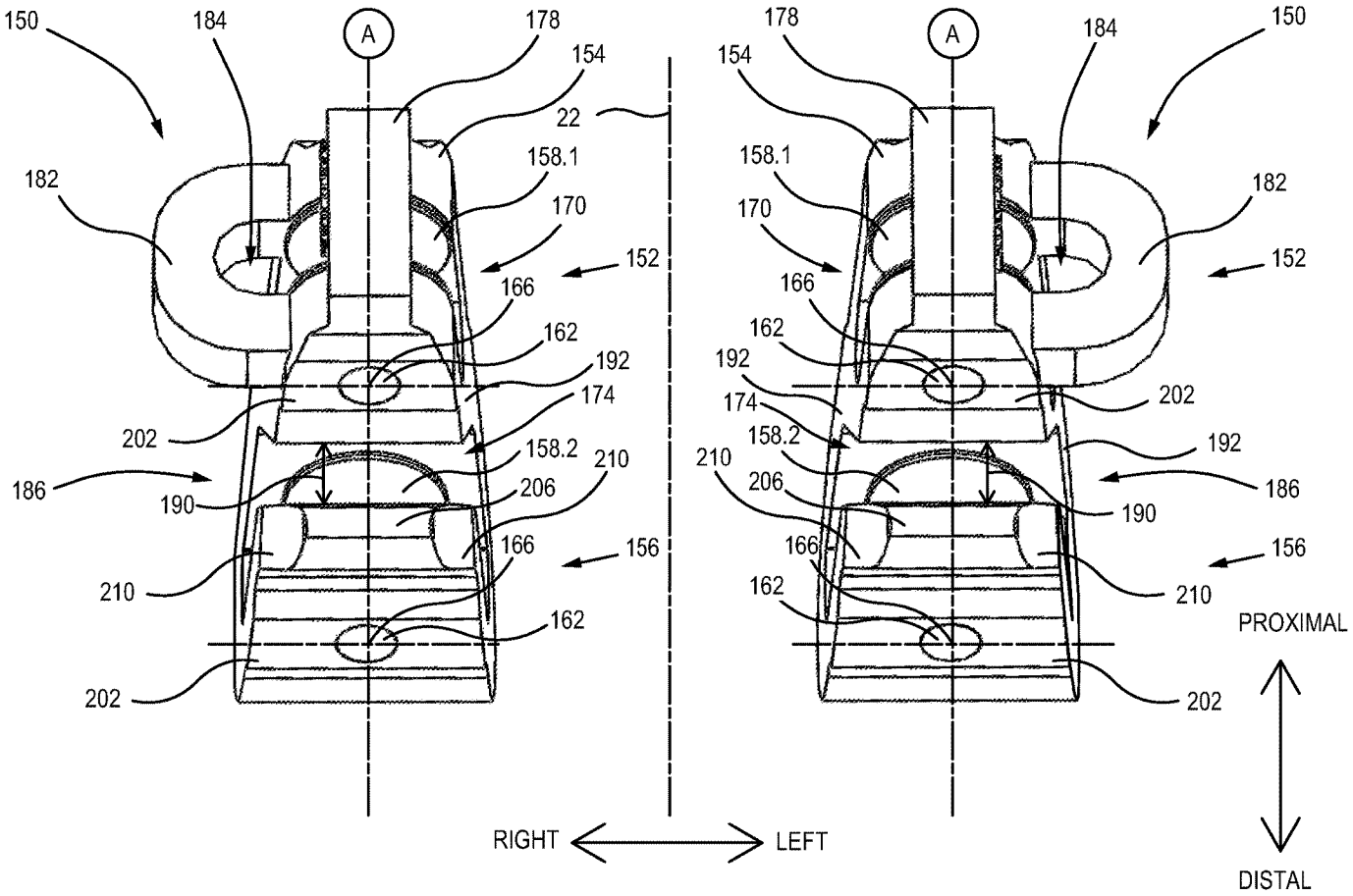
FIG. 9 is a top front elevation view of a pair of string connectors in accordance with an embodiment of the present invention.
Figure 10:
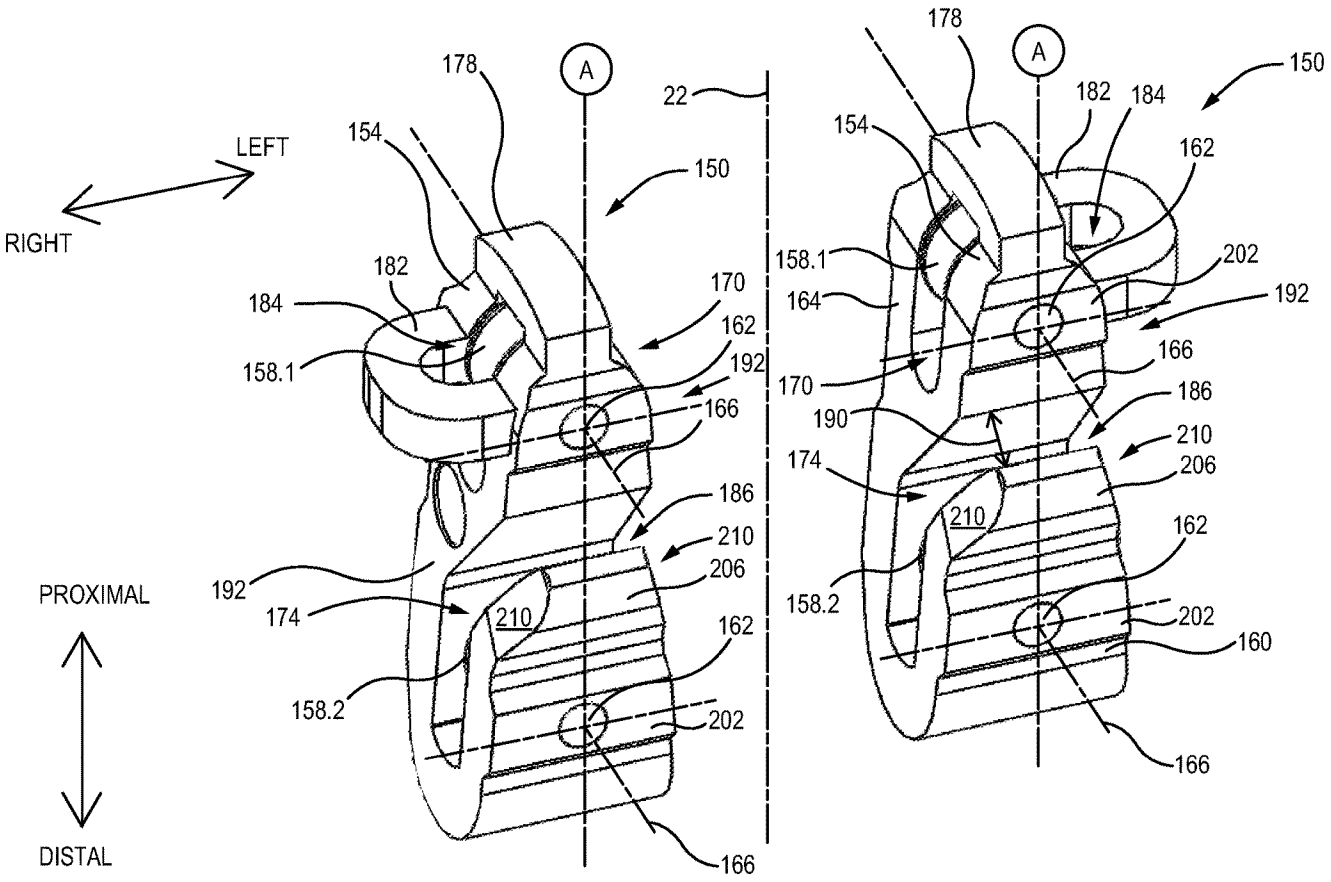
FIG. 10 is a front top right elevation view of a pair of string connectors in accordance with an embodiment of the present invention.
Figure 11:
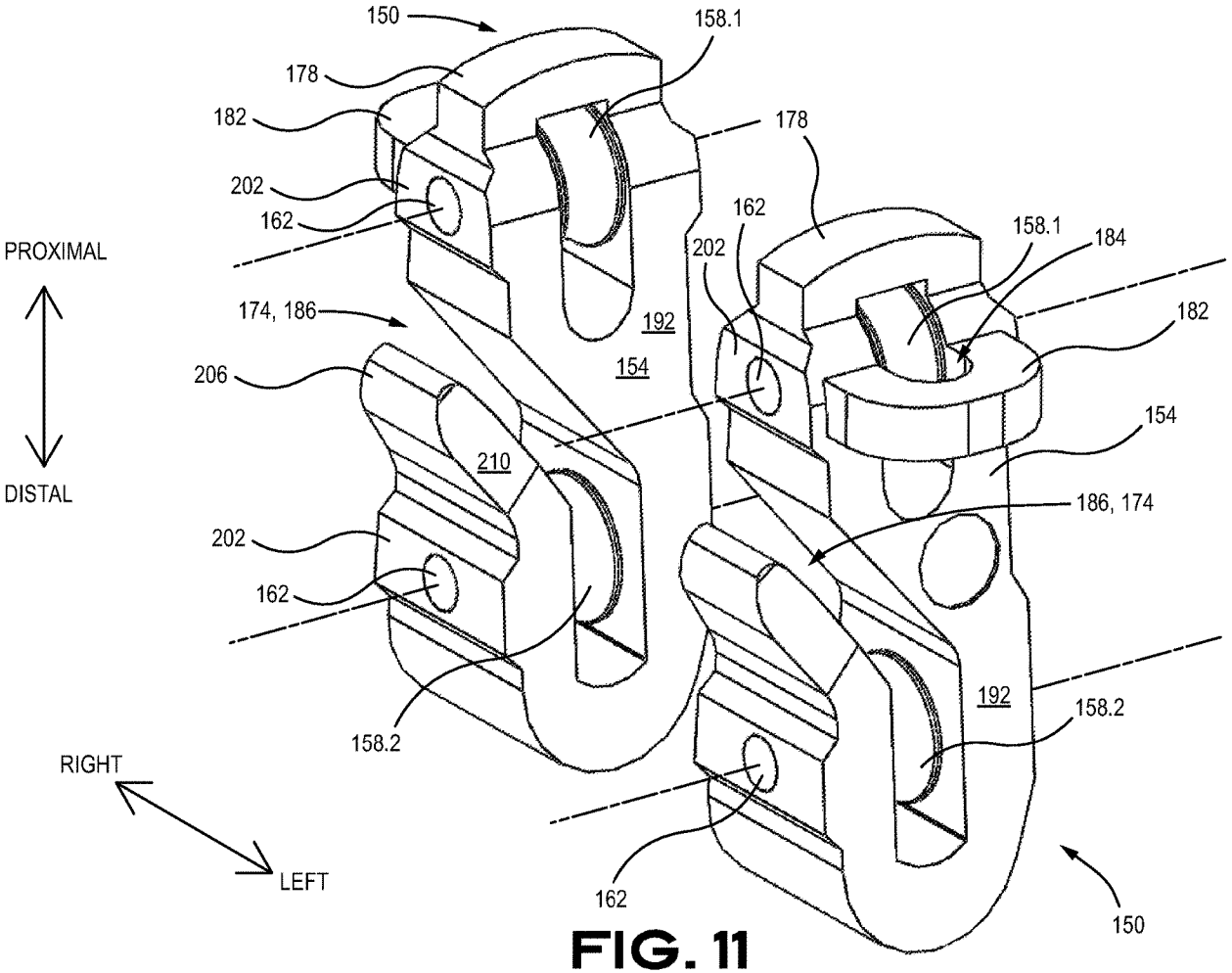
FIG. 11 is a left top front elevation view of a pair of string connectors in accordance with an embodiment of the present invention.

FIG. 9 throughout FIG. 11 are illustrating a pair of string connectors 150 designed to mirror each other in accordance with at least one embodiment of an operating configuration. The pair of sting connectors 150 is embodied to receive therein the string 32 from the upper direction although the pair of string connectors 150 could alternatively be installed on the crossbow 10 in the opposite direction for inserting the string 32 from the downward direction. The pair of sting connectors 150 is generally identical however the side bridge supports 182 are respectively disposed on lateral sides of the body 154 (not illustrated) in respect with the longitudinal axis 22. The side bridge supports 182 are disposed on the side opposed to the stock 34 of the crossbow 10 to avoid any direct contact with the crossbow 10 when the string connectors 150 are operatively installed on the crossbow 10 for cocking the string 32. It can be appreciated from FIG. 9 throughout FIG. 11 that the sting connectors 150 are adapted to operate parallel to one another with the pair of bearing members 158 aligned despite the non-parallel sides 192 of the string connectors 150. The sting connectors 150 are maintained parallel to one another in the operating configuration by the rope 118. The diameter of the rope 118 in cooperation with the bearing member 158 is maintaining plane A, representing the alignment of the two bearing member axes 166, of each string connector 150 substantially parallel to the longitudinal axis 22 of the crossbow 10 and the sides of the body 46.

Figure 12:
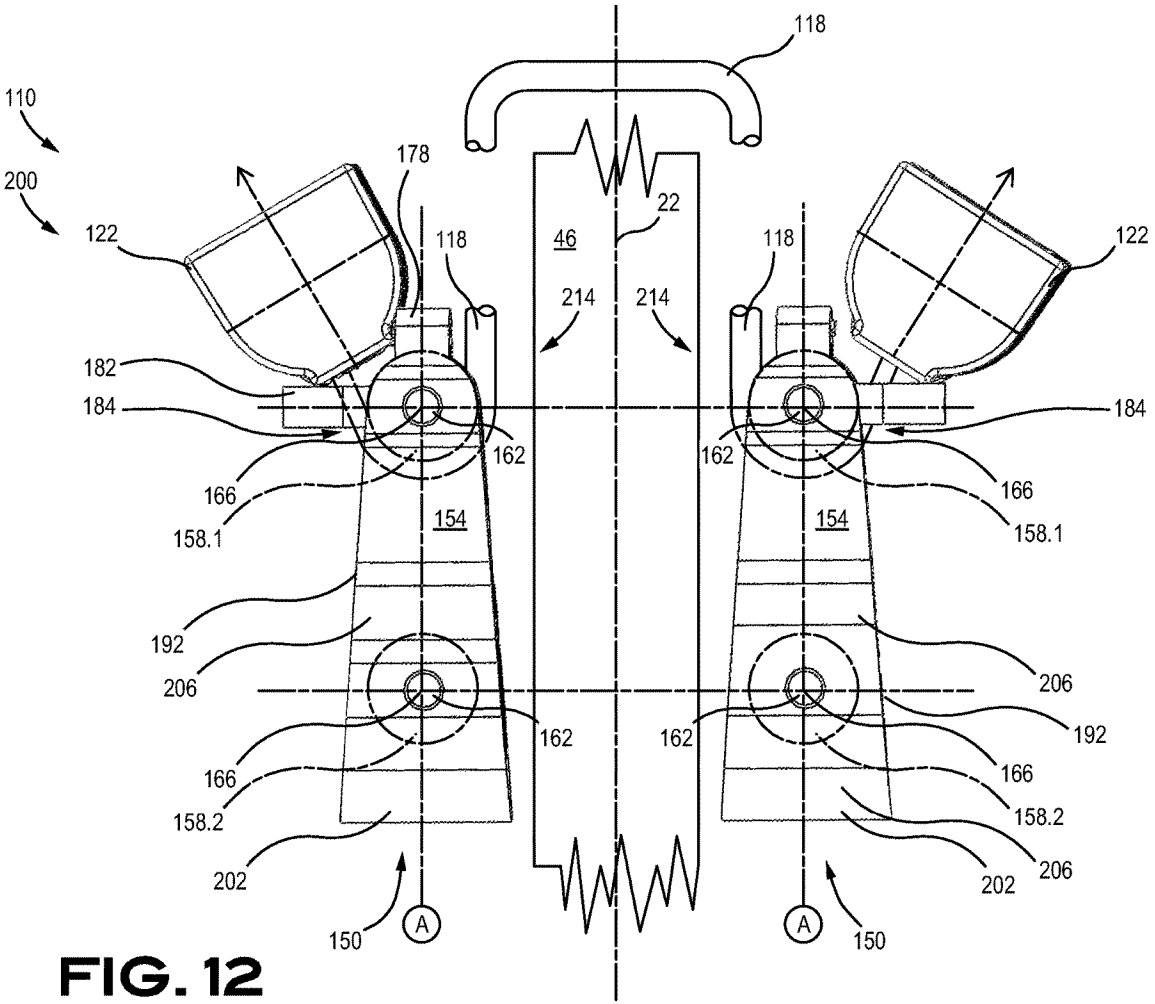
FIG. 12 is a rear elevation view of a pair of rope cockers in cooperation with a body of a crossbow and a pair of handles in accordance with an embodiment of the present invention.
Figure 13:
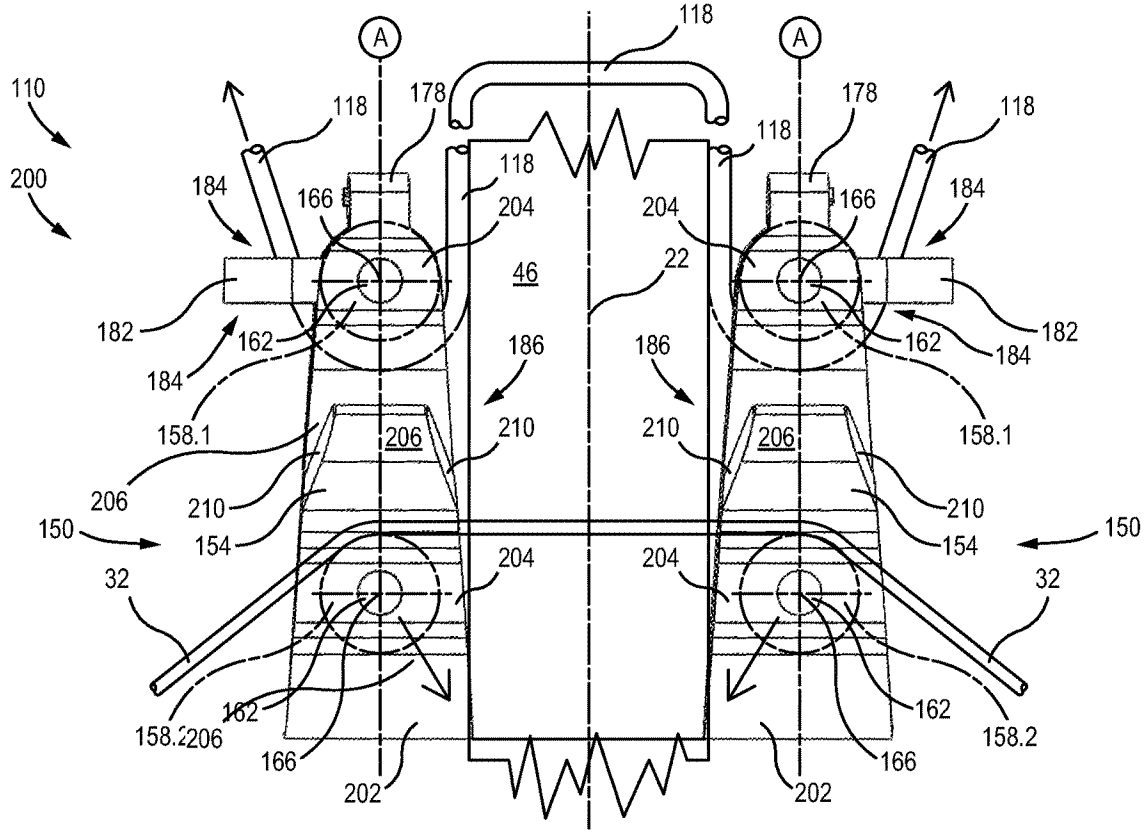
FIG. 13 is a front elevation view of a pair of rope cockers in cooperation with a body and the string of a crossbow in accordance with an embodiment of the present invention.

The rope 118, as exemplified in FIG. 12 and FIG. 13 with the pair of string connectors 150 in an operational configuration 200 with the crossbow before cocking the string 32, is adapted to contact 214 the body 46 of the crossbow 10 to protect the barrel 46 of the crossbow 10 and to reduce noises that could be generated by friction between the string connectors 150 and the barrel 46 of the crossbow 10. The rope 118 remains still in respect with the barrel 46 upon cocking the crossbow 10 and ensures guidance of the sting connectors 150 when moving along the body 46 of the crossbow 10. The diameter of the rope 118 also distances the string connector 150 from the crossbow 10 to clear any fasteners on the barrel 46 of the crossbow 10 that could interfere with the travel of the string connector 150. There are also preferably no protruding shapes on the side of the string connector 150 that is facing the body 46 of the crossbow 10 to further prevent any interference with the crossbow 10.

In reference with FIG. 12, one can appreciate the string connector 150 are configures to receive and locate the handles 122 as a handle support when the string connector 150 is in an operating configuration with the crossbow 10. The length of the rope 118 biases the handles 122 toward the string connectors 150 and the bridge supports 178 and 182 with tension from the string 32. The handles 122 are hence contacting the string connector 150 and are positioned upward toward the user 90, and orthogonally from the longitudinal axis 22 of the crossbow 10, to facilitate the user 90 to grab the handles 122 and cock the crossbow 10.

Figure 14:
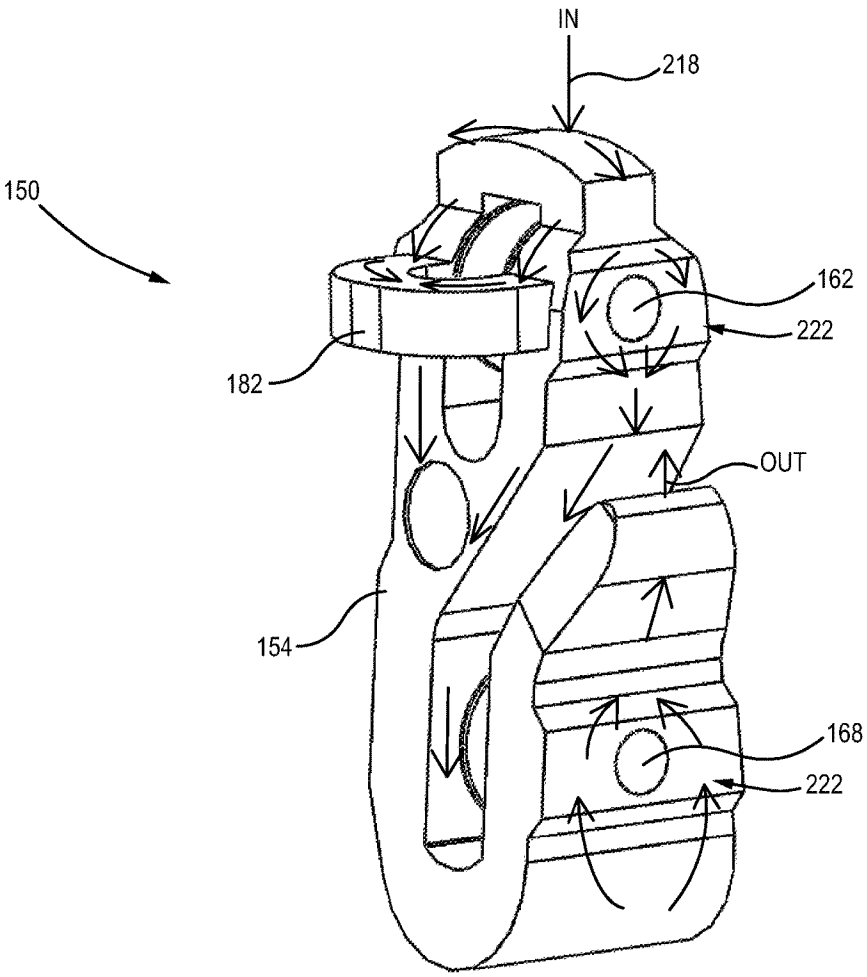
FIG. 14 is a front left elevation view of a string connector with injection flow pattern identifications in accordance with an embodiment of the present invention.

The design of the string connector 150 allows for a symmetrical injection flow when manufactured with an injection process. Indeed, the design of the string connector 150 can be injected in a mold from injection position 218. Injection material is going to flow substantially evenly on both sides of the openings 222 intended to receive the axles 162 therein. This substantially symmetrical injection flow pattern, illustrated by the arrows in FIG. 14, around the openings 222 provides optimal injection material distribution in the mold and increases the strength of the string connector 150.

Figure 15:
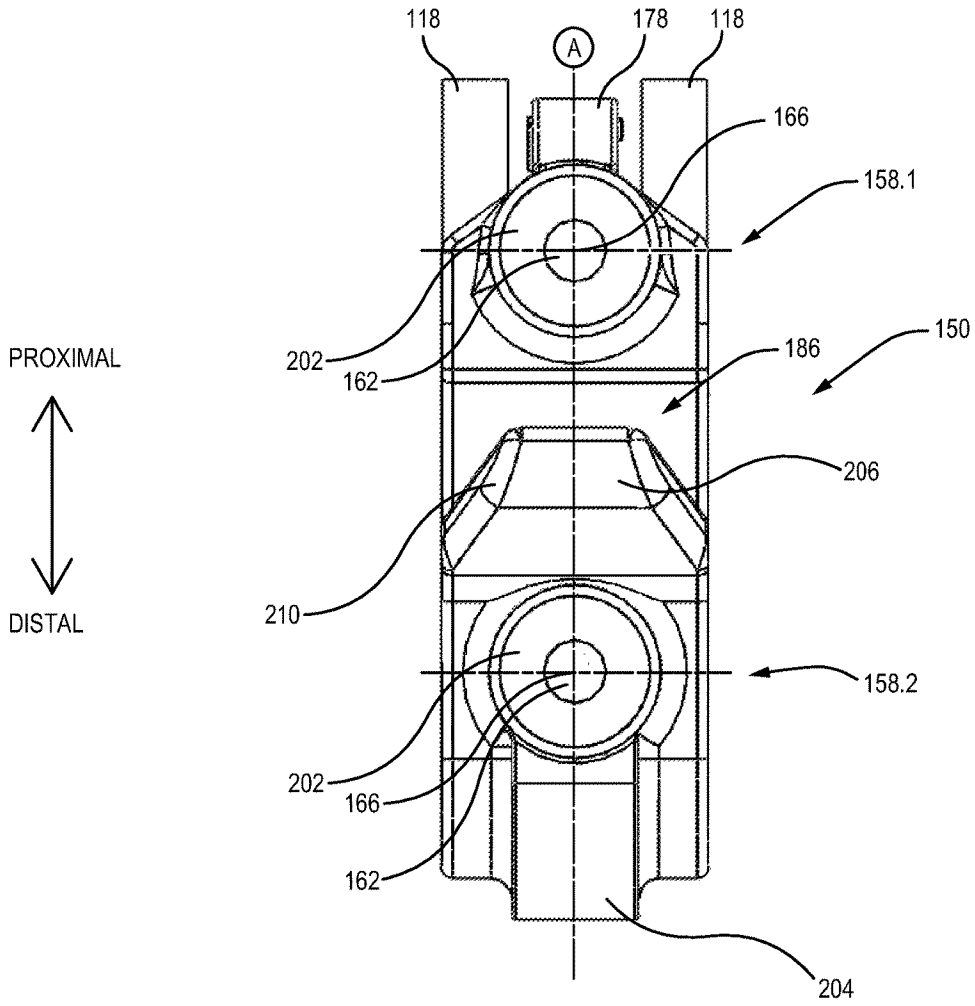
FIG. 15 is a front elevation view of a string connector in accordance with an embodiment of the present invention.

FIG. 15 illustrates an alternate embodiment of the string connector 150 having a different design that is encompassed by the present invention. The illustrated embodiment includes a series of radiuses creating a string connector 150 that has a smoother surface. A distal reinforcement 204 is provided on the lower portion of the string connector 150 and is preferably interconnecting both ends of the bearing member axles 162.

Figure 16:
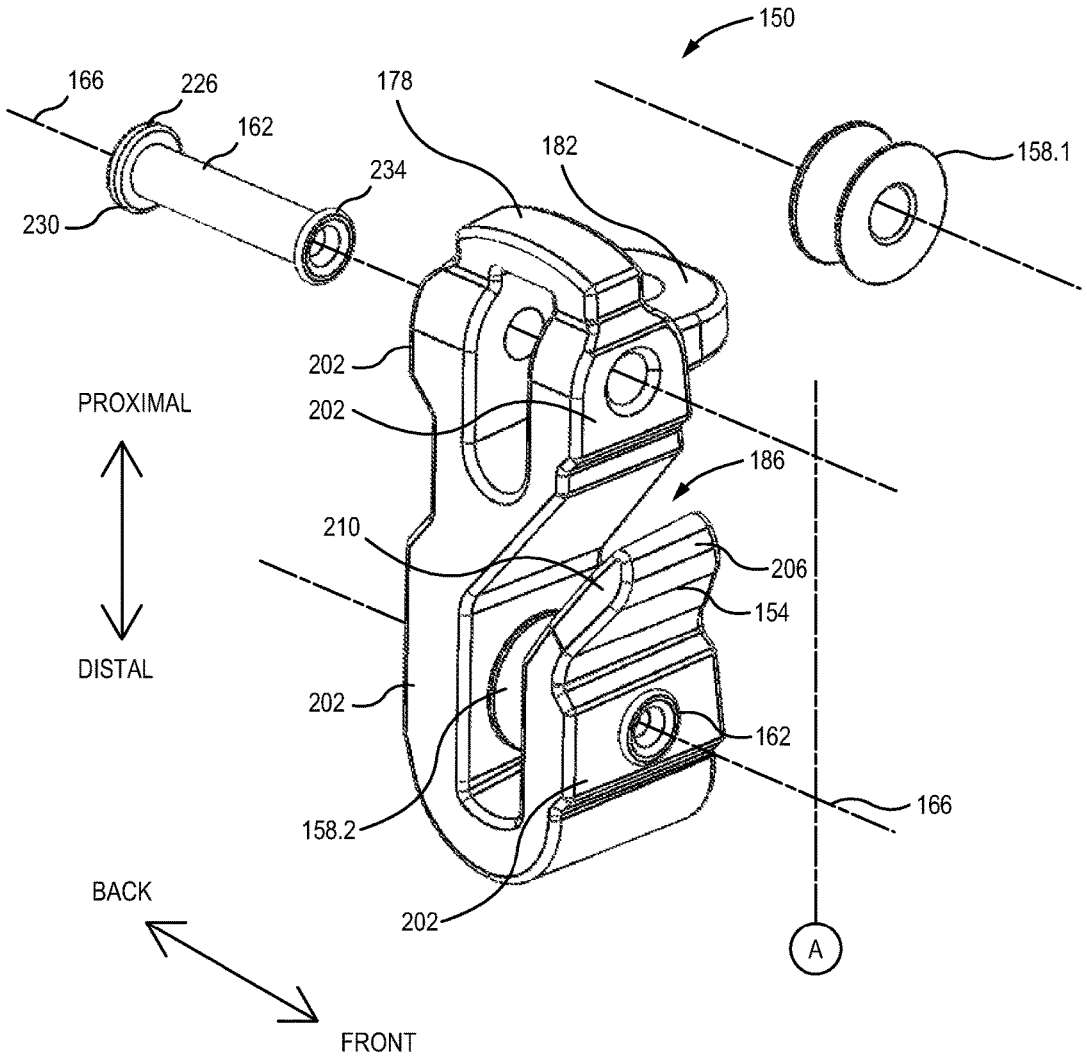
FIG. 16 is a right front elevation view of a string connector assembly in accordance with an embodiment of the present invention.
Figure 18:
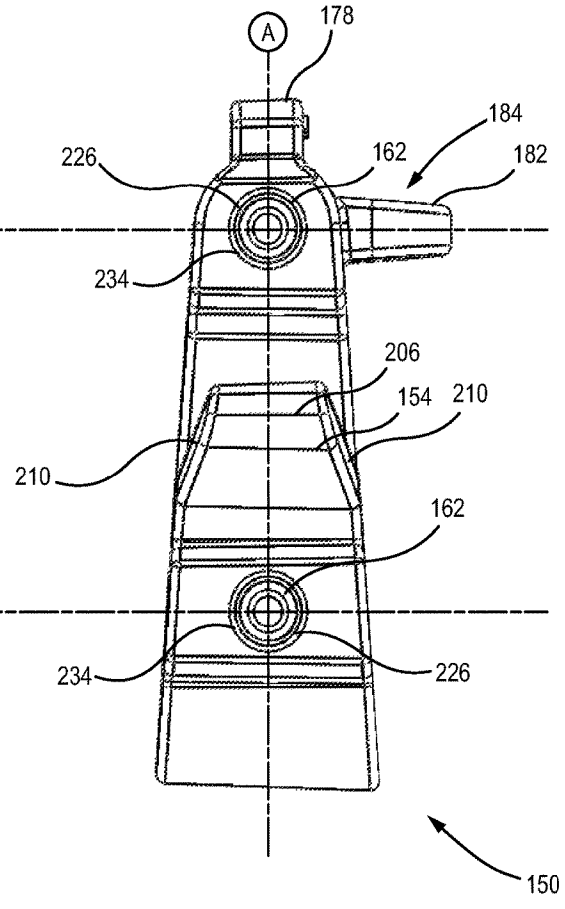
FIG. 18 is a front elevation view of a string connector in accordance with an embodiment of the present invention.
Figure 17:
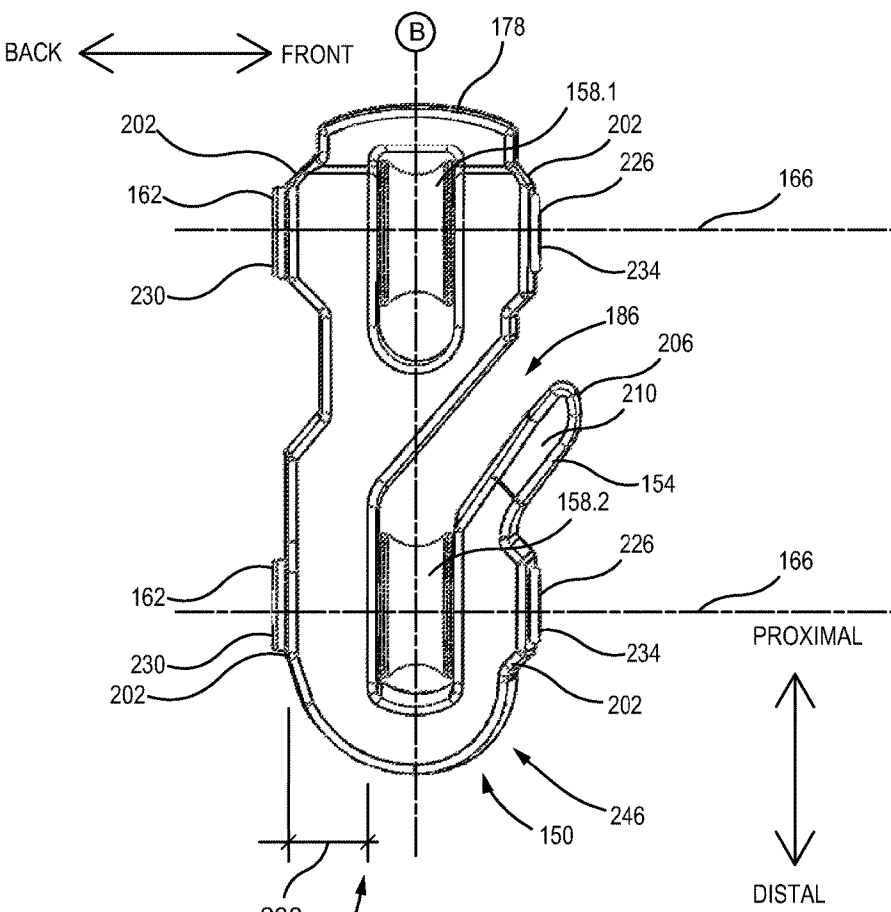
FIG. 17 is a left elevation view of a string connector in accordance with an embodiment of the present invention.
Figure 20:
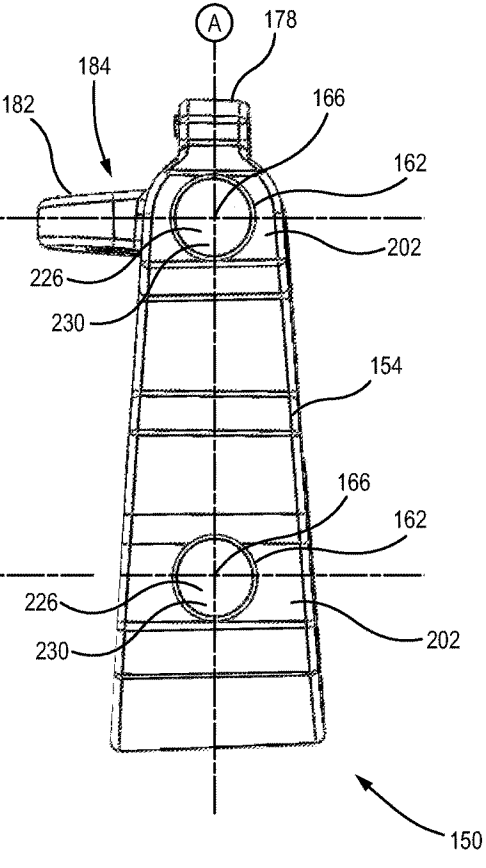
FIG. 20 is a rear elevation view of a string connector in accordance with an embodiment of the present invention.
Figure 19:
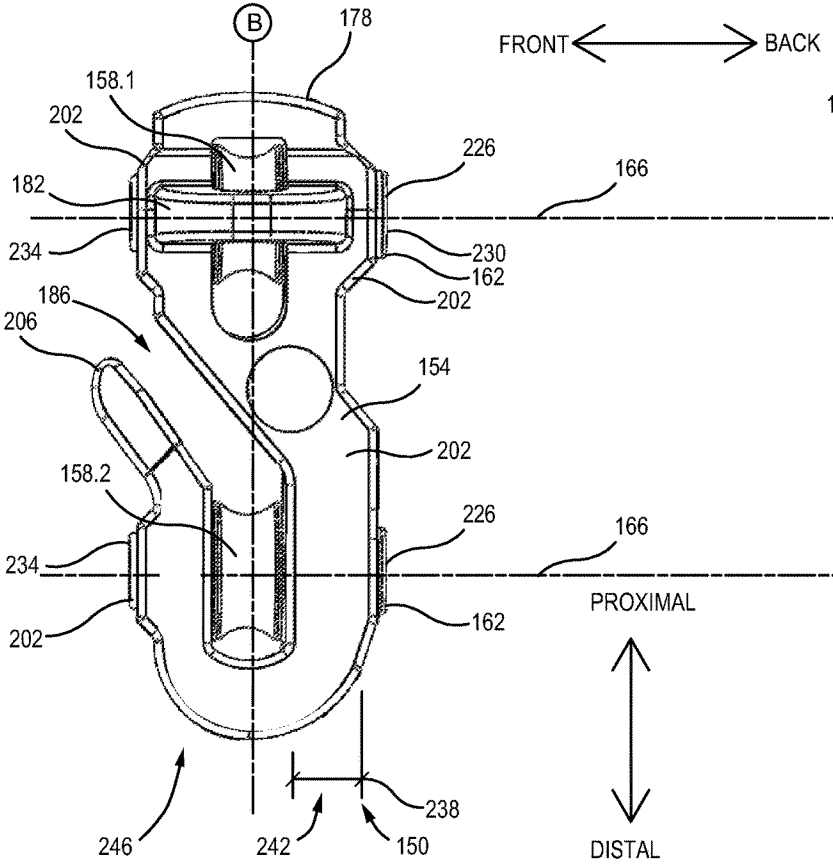
FIG. 19 is a left elevation view of a string connector in accordance with an embodiment of the present invention.
Figure 23:
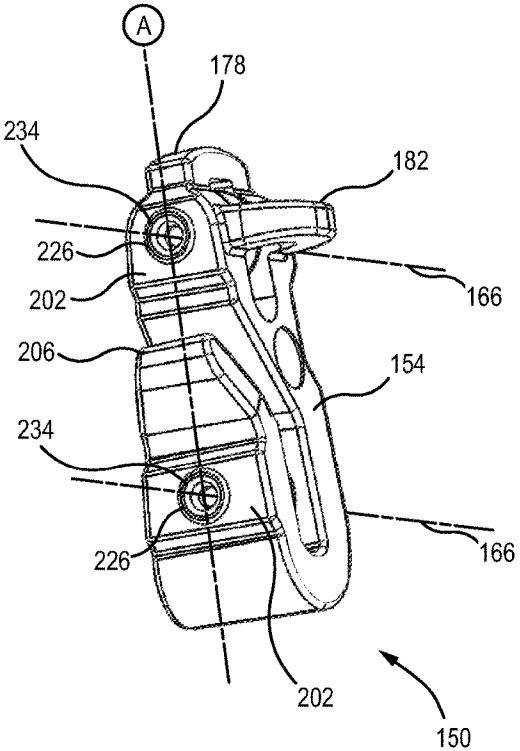
FIG. 23 is a front left elevation view of a string connector in accordance with an embodiment of the present invention.
Figure 22:
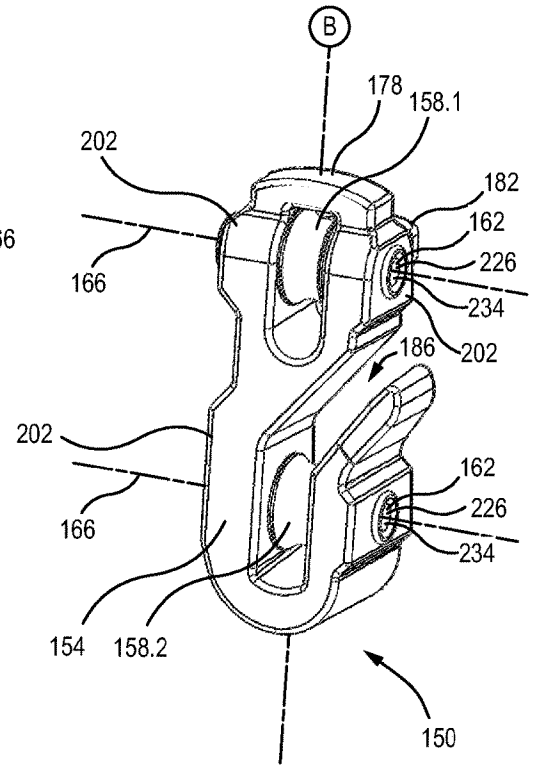
FIG. 22 is a right front elevation view of a string connector in accordance with an embodiment of the present invention.
Figure 21:
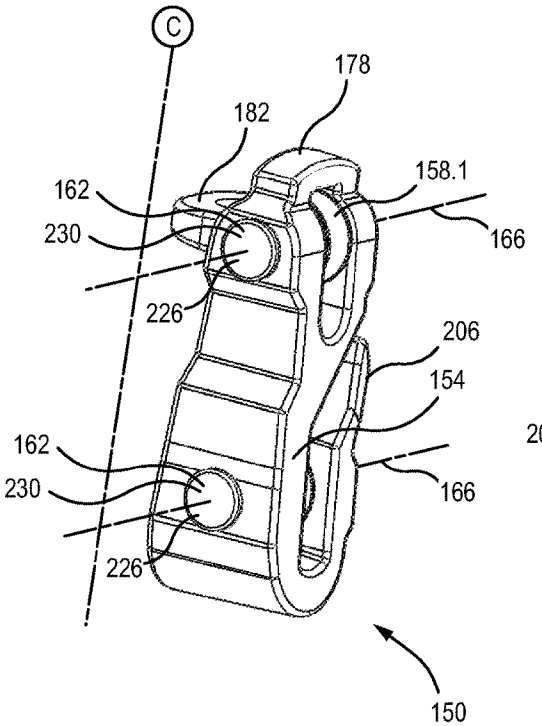
FIG. 21 is a rear elevation view of a string connector in accordance with an embodiment of the present invention.

Moving now to FIG. 16 throughout FIG. 23 depicting an alternate embodiment of the string connector 150. The bearing members 158 are made of a polymer material, like Acetal, and rotatably secured to the body 154 with a rivet 226 serving as axle 162 supporting the bearing members 158. The rivet 226 includes a head portion 230 and a deformable portion 234. The rivet 226 is fixedly secured to the body 154 and the bearing member 158 is sized and designed to freely rotate around the rivet 226. The rivet 226 is also retaining the body 154 to support a force applied on the elongated hook portion 206 and prevent opening of the cavity in which the bearing member 158.2 is housed. An increased wall thickness 238 of a back side 242 of the body 154, compared to the front side 246 of the body 154, is provided to improve the mechanical strength of the assembly.

Figure 24:
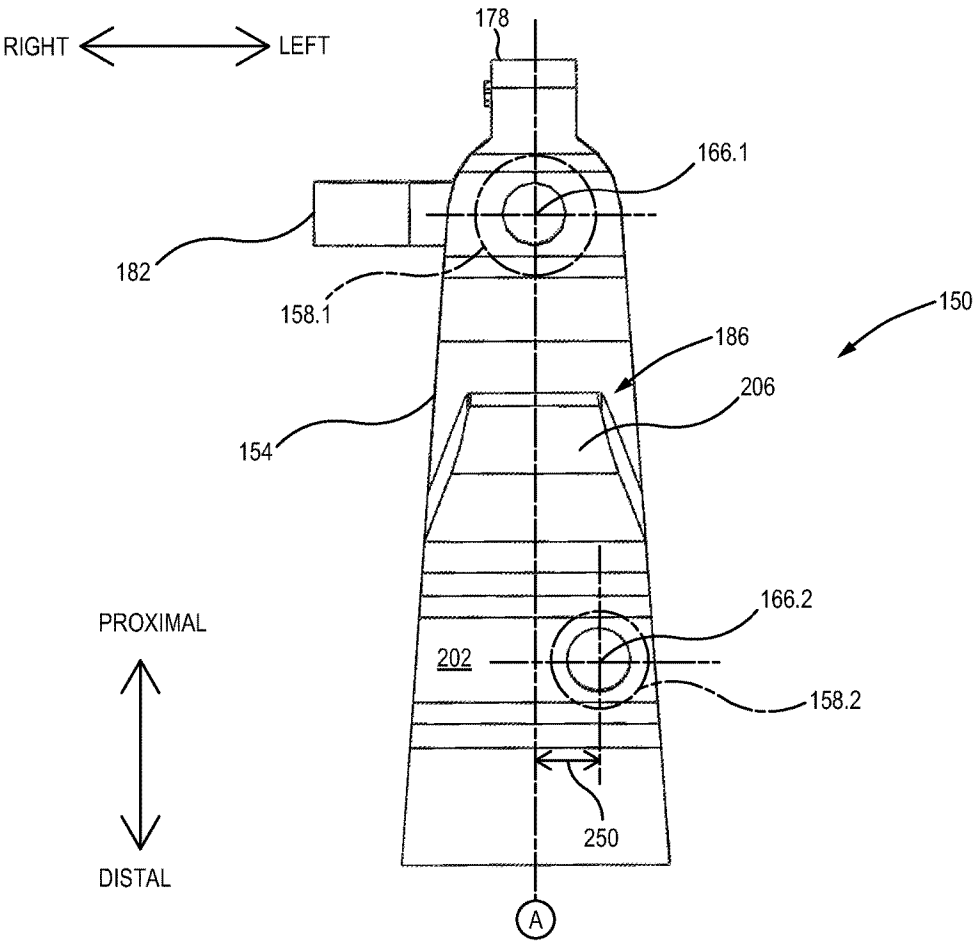
FIG. 24 is a front elevation view of a string connector with an offset lower pulley in accordance with an embodiment of the present invention.
Figure 25:
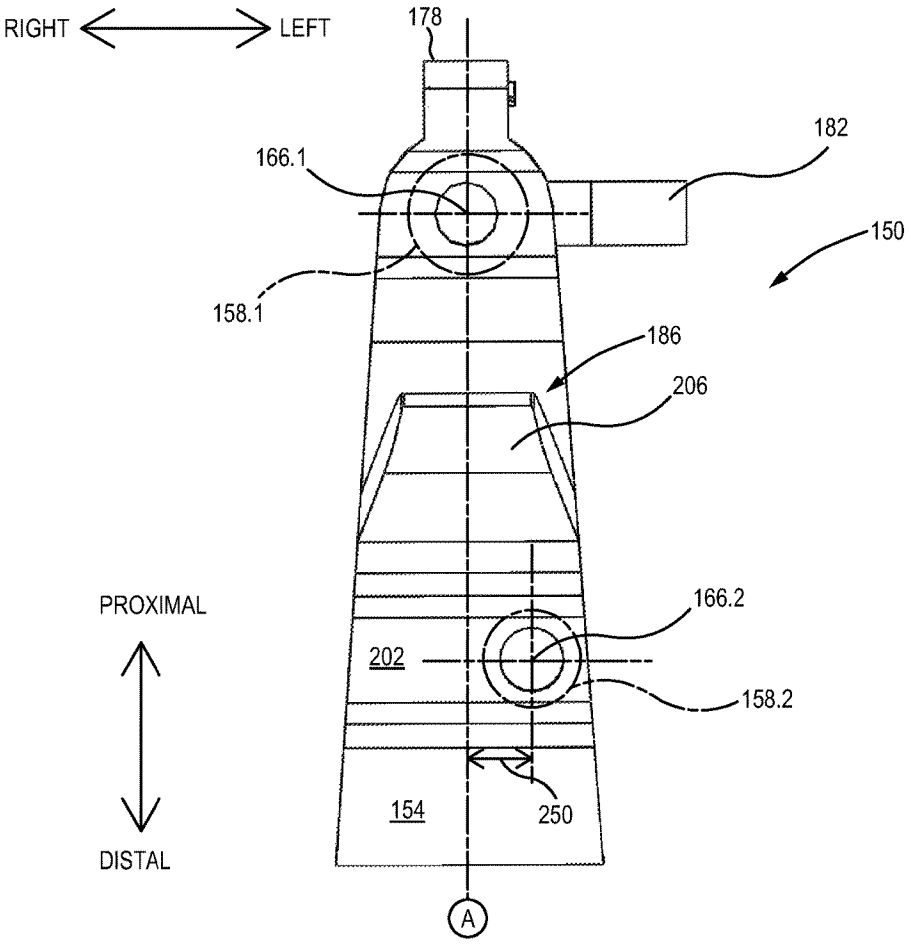
FIG. 25 is a front elevation view of a string connector with an offset lower pulley in accordance with an embodiment of the present invention.
Figure 26:
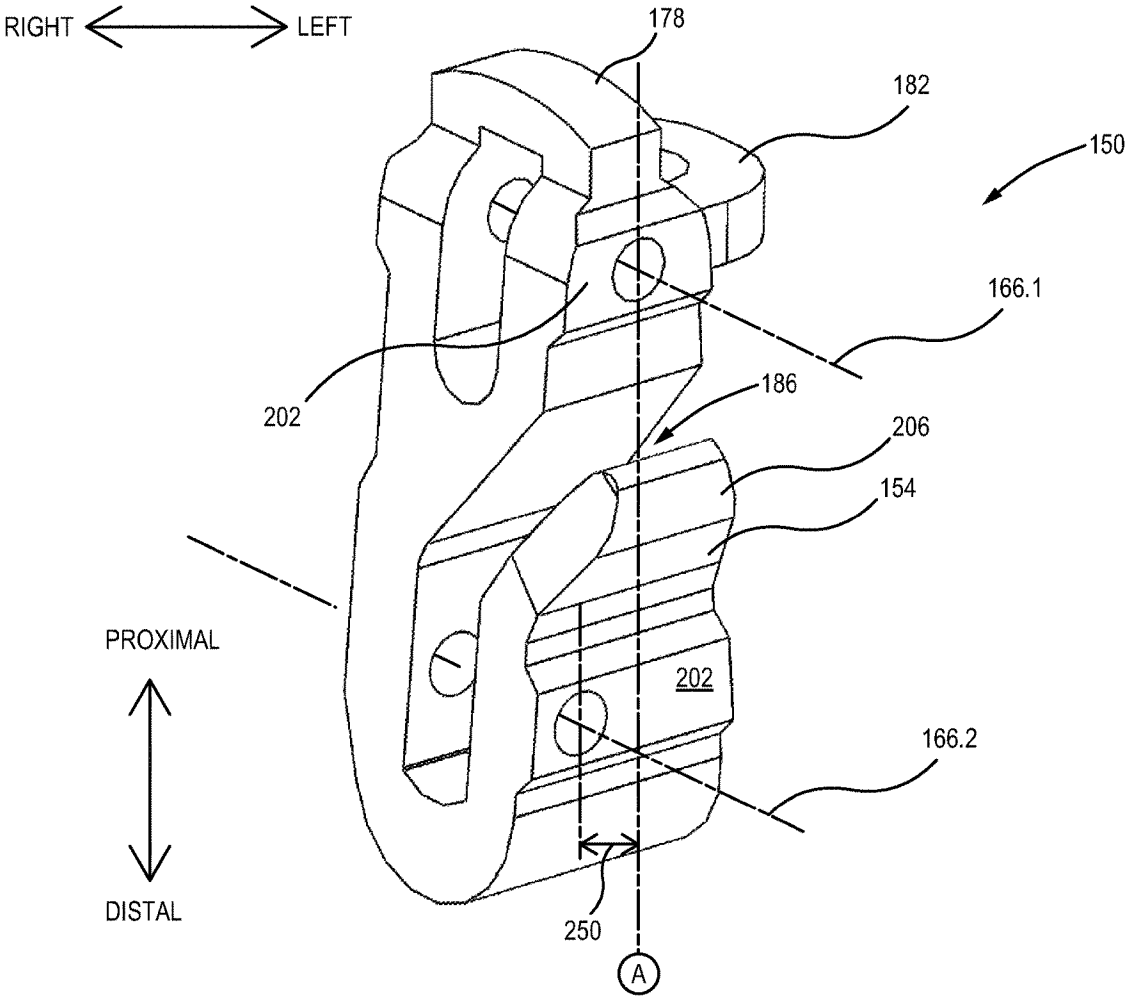
FIG. 26 is front right elevation view of a string connector with an offset lower pulley in accordance with an embodiment of the present invention.

FIG. 24, FIG. 25 and FIG. 26 are illustrating another embodiment of the string connectors 150. The lower bearing member 158.2 and its axis 166.2 are offset 250 from central axis A. The lower bearing member 158.2 is offset to laterally locate the string 32 (not illustrated) in a desired position and consequently locate the string-receiver 150 at a slight angle thereof in respect with the vertical. The diameter of the lower bearing member 158.2 can be of a different size than the diameter of the upper bearing member 158.1 to improve cooperation with the string 32 that generally has a smaller diameter than the rope 118.

Figure 27:
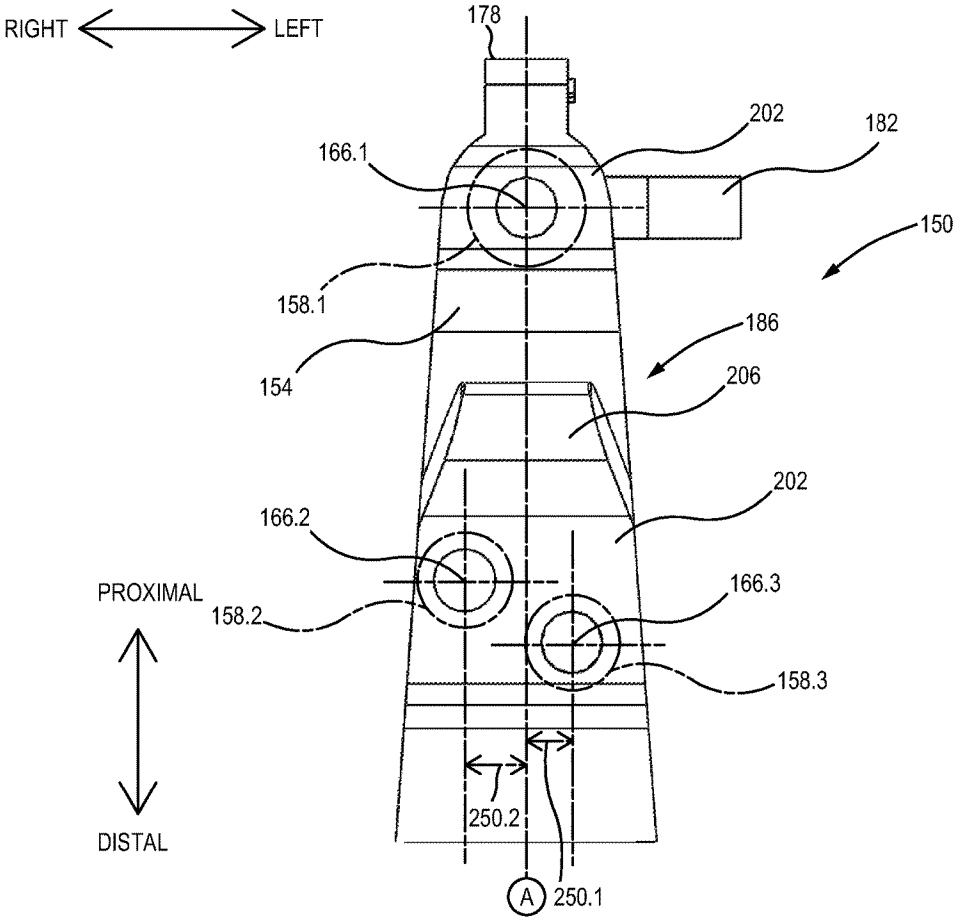
FIG. 27 is a front elevation view of a string connector with a pair of offset lower pulleys in accordance with an embodiment of the present invention.
Figure 28:
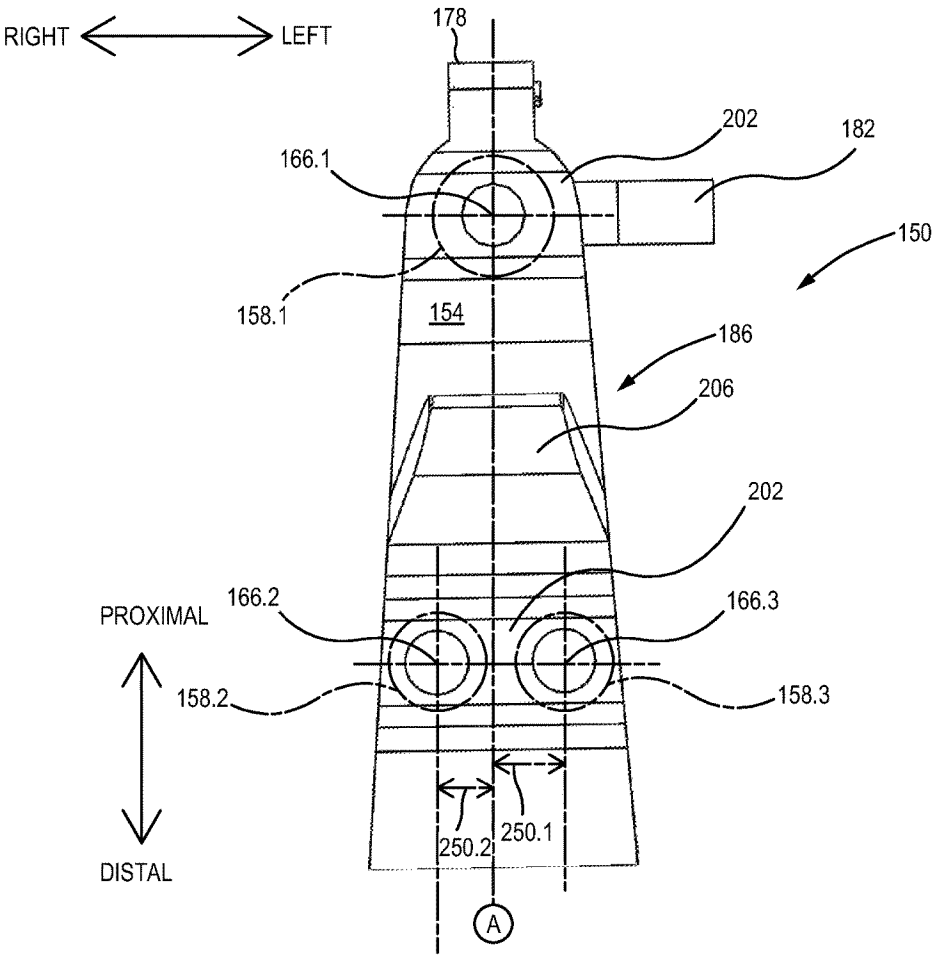
FIG. 28 is a front elevation view of a string connector with a pair of offset lower pulleys in accordance with an embodiment of the present invention.
Figure 29:
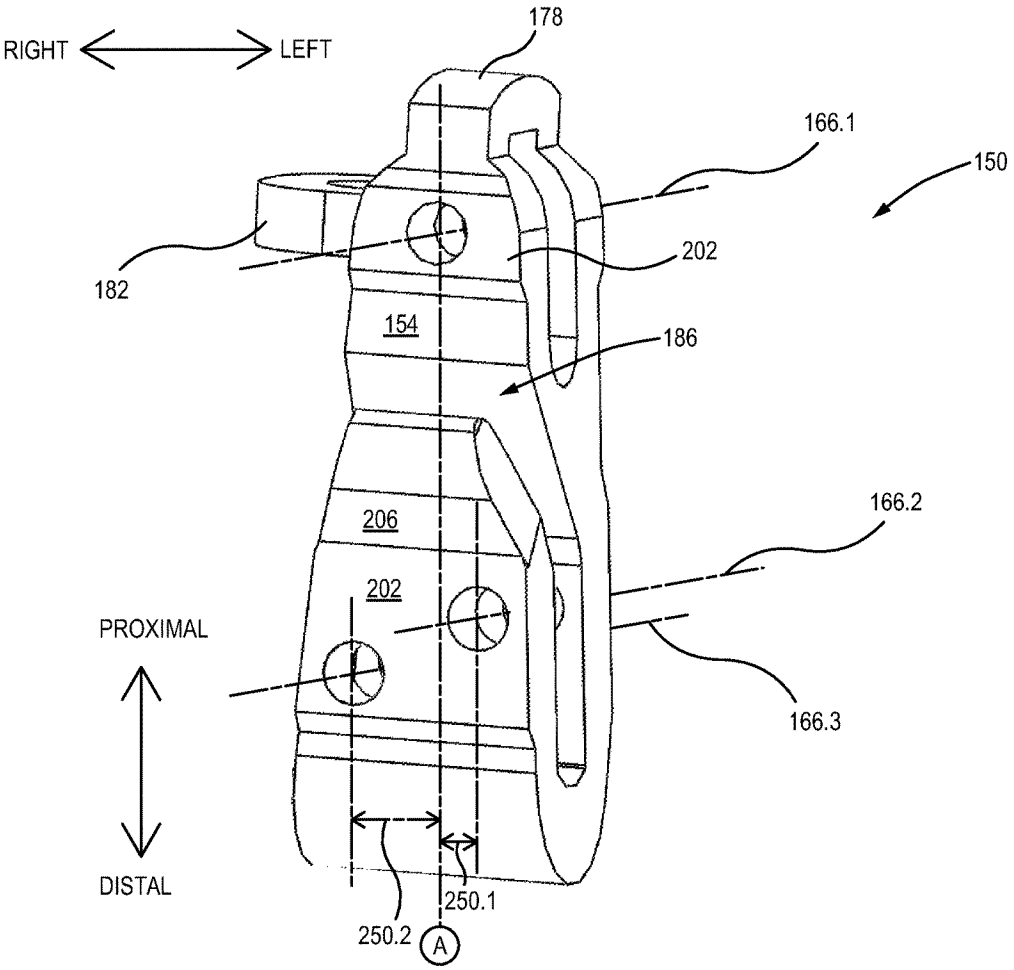
FIG. 29 is a front left elevation view of a string connector with a pair of offset lower pulleys in accordance with an embodiment of the present invention.
Figure 30:
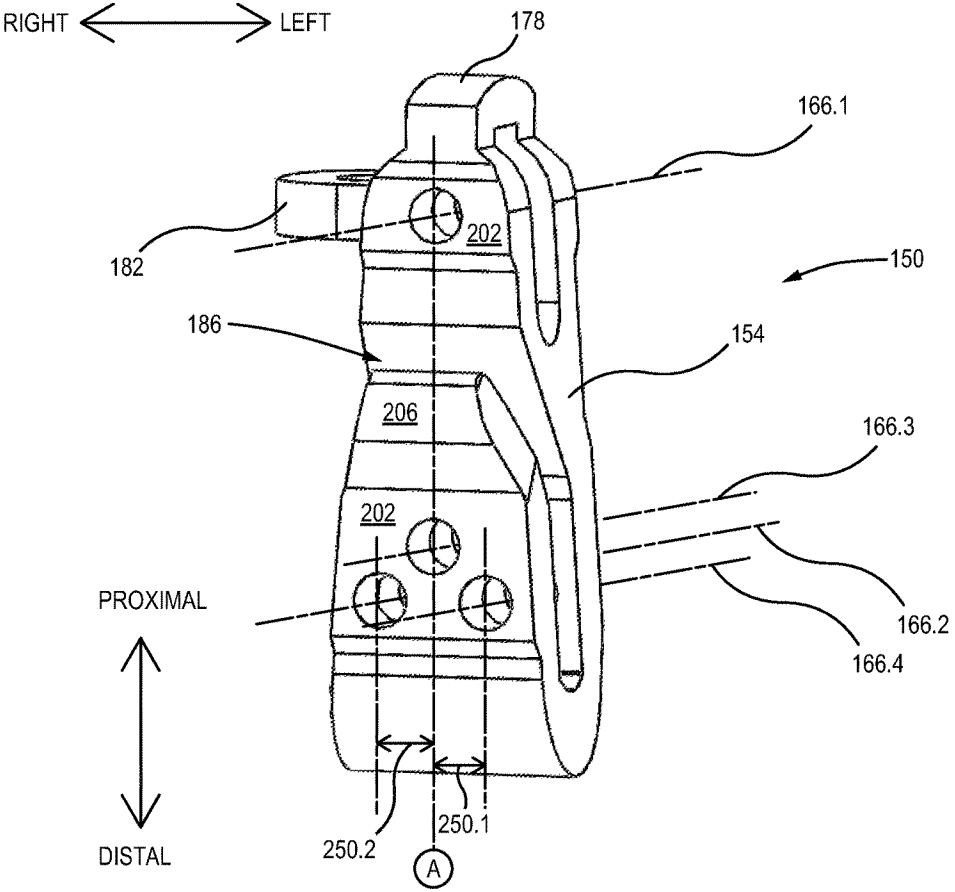
FIG. 30 is a front left elevation view of a string connector with a plurality of offset lower pulleys in accordance with an embodiment of the present invention.
Figure 31:
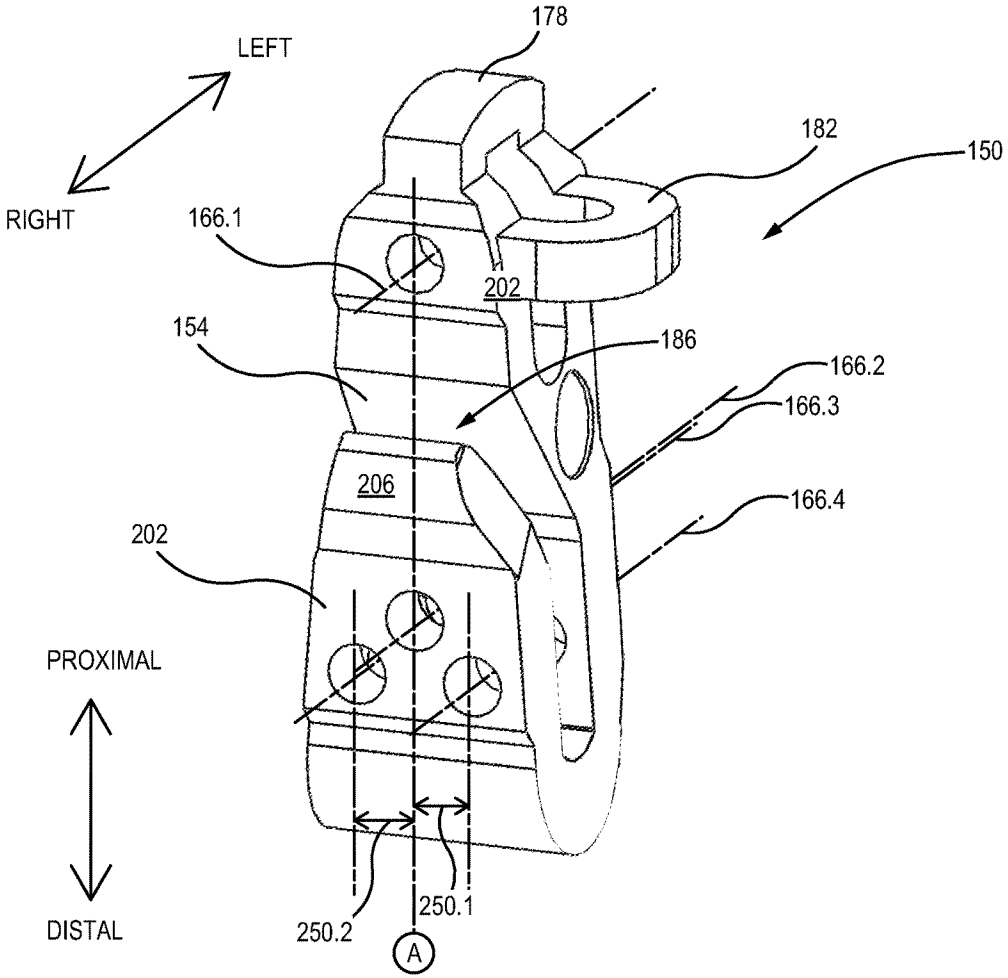
FIG. 31 is a front right elevation view of a string connector with a plurality of offset lower pulleys in accordance with an embodiment of the present invention.

FIG. 27 throughout FIG. 29 are depicting embodiments of the string connectors 150 equipped with one upper bearing member 158.1 and two lower bearing members 158.2, 158.3 adapted to rotate about their respective axis 166.2 and 166.3. The multiple lower bearing members 158.2, 158.3 are located on the body 154 of the string connector 150 to establish a progressive string 32 (not illustrated) bending allowing a larger radius of curvature for the string 32, allow for a more precise location of the string 32 about the body 154 and share pressure on the plurality of bearing members 158. The diameter of the bearing members 158.1, 158.2 and 158.3 can be adjusted to fit the available space in the body 154. One can appreciate the lower bearing members 158.2 and 158.3 can be located at a different height, as illustrated in FIG. 27 and FIG. 29, or at a similar height as illustrated in FIG. 28. FIG. 30 and FIG. 31 exemplify a string connector 150 with a set of three (3) lower bearing members 158.2, 158.3 and 158.4. Each bearing member 158.2, 158.3 and 158.4 is located and configured to rotate about its respective axis 166.2, 166.3, 166.4. The size of the bearing members 158, their locations and the respective distance among the bearing members 158.2, 158.3 and 158.4 can vary depending on the type and size of string 32 (not illustrated) and other design variables without departing from the scope of the present invention.

Figure 32:
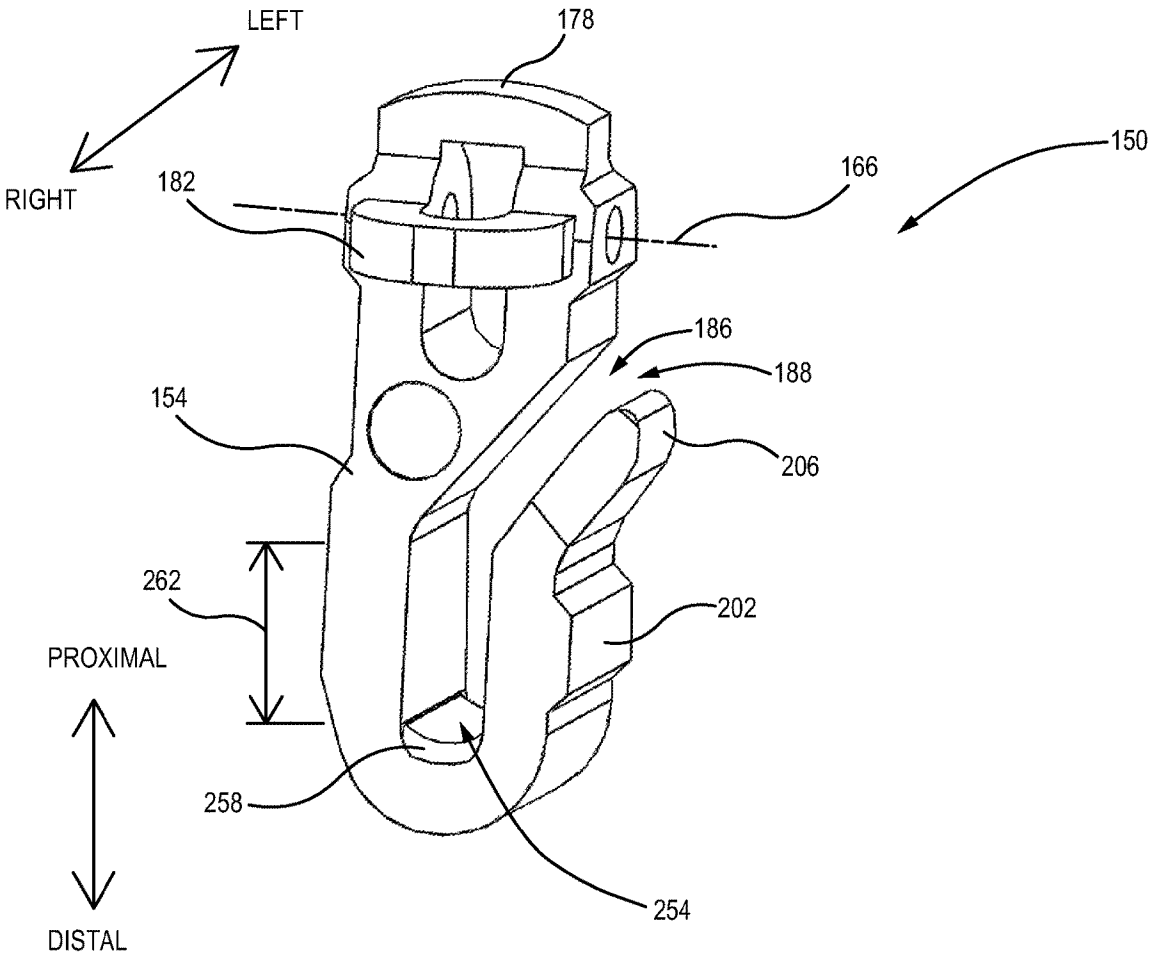
FIG. 32 is a right elevation view of a string connector with a single upper pulley in accordance with an embodiment of the present invention.
Figure 33:
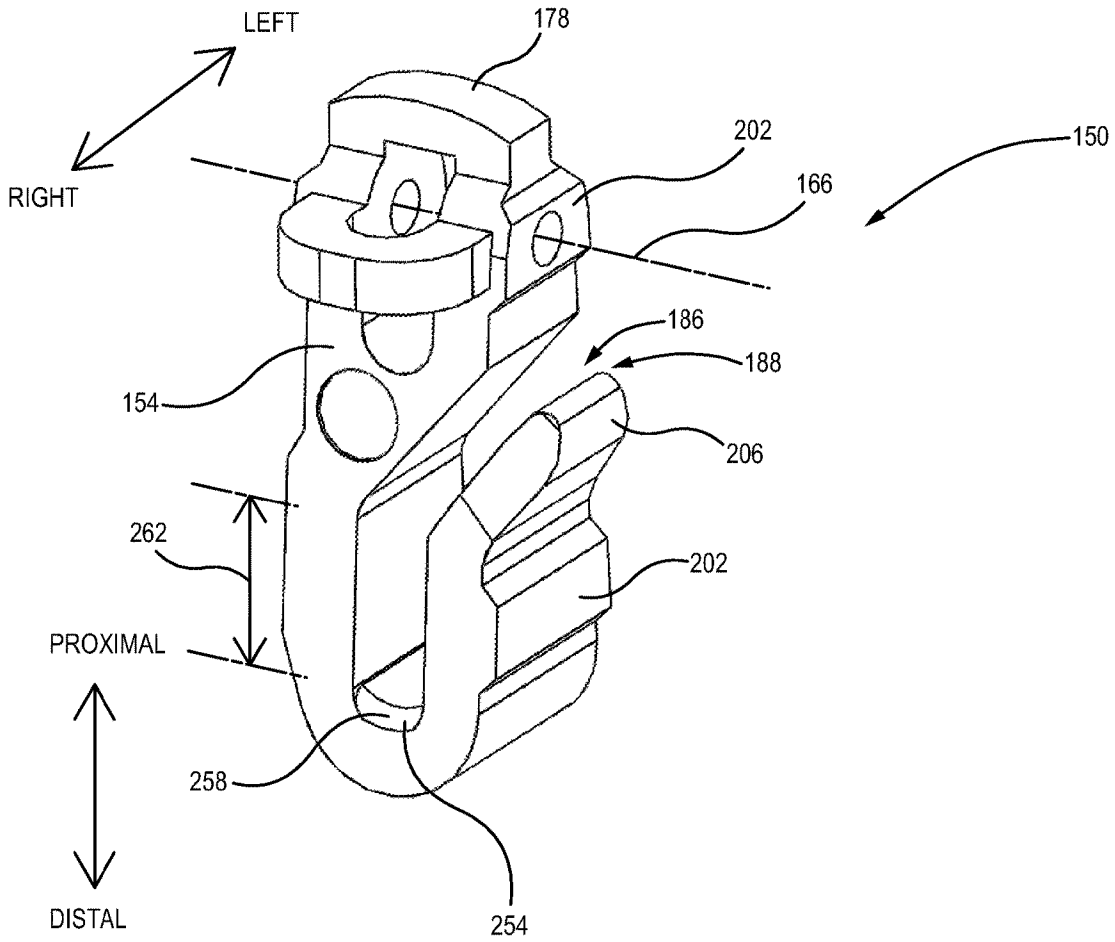
FIG. 33 is a right elevation view of a string connector with a single upper pulley in accordance with an embodiment of the present invention.

A string connector 150 including only an upper bearing member 158 (not illustrated) about the axis 166 is embodied in FIG. 32 and FIG. 33. The lower pulley(s) has been removed to simplify the string connector 150 design and assembly. The relative movement of the string 32 (not illustrated) is generally small and a bearing area 254 on the body 154 can receive the string 32. Alternatively, a piece 258 of low-friction material, such as Teflon™, can be located on the body 154 and serves as a bearing area. The piece 258 of low-friction material protects the body 154 and can be designed to be replaced if needed. The height of the string connector 150 can be reduced given there is no need to house the lower pulley by diminishing the height of the hook portion 262 following the opening 186 and the string-engaging portion 188. Reduction of the height of the string connector 150 is going to further reduce the length of the cocking movement of a user.

Should the string connector 150 has no distal rotatable bearing member 158 and has a bearing surface, the bearing surface on which the string 32 is going to contact could be embodied with a significant radius on the side where the string 32 is going to connect the limb 66 to reduce the radius of curvature thereof hence reducing the stress caused by a tight radius of curvature. The edge of the bearing surface on the side of the barrel 46 could be straight or have a smaller radius because the string is not going to bend in this direction. In other words, the string-contacting bearing surface has an asymmetric shape with a larger radius on the side toward the limb 66.

The description and the drawings that are presented above are meant to be illustrative of the present invention. They are not meant to be limiting of the scope of the present invention. Modifications to the embodiments described may be made without departing from the present invention, the scope of which is defined by the following claims:

What is claimed is:

1. A cocker apparatus for cocking a string of a crossbow, the cocker apparatus comprising:

a rope;

a pair of handles secured to respective ends of the rope; and a pair of string connectors operatively secured by the rope between the pair of handles, each of the pair of string connectors comprising a body;

a rope-connecting portion including a bearing member rotatably secured to the body about an axle and a bearing member rotation axis thereof for supporting translational movements of the rope thereon;

a string-connecting portion including a non-rotatable bearing area for supporting pressure and translational movements of the string of the crossbow when cocking the crossbow; and a bridge support connected to the body for locating the handle in a user-receiving position when the rope cocker is in a position ready for cocking by a user.

2. The cocker apparatus of claim 1, wherein the body comprises an opening housing the first bearing member and receiving the rope therethrough, the bridge support extending over the opening.

3. The cocker apparatus of claim 1, wherein the bearing area includes polymer material.

4. The cocker apparatus of claim 1, wherein the bridge support is adjacent to the bearing member.

5. The cocker apparatus of claim 1, wherein the bridge support is substantially parallel to the bearing member rotation axis.

6. The cocker apparatus of claim 1, wherein the bridge support is a first bridge support and wherein the rope-connecting portion further comprises a second bridge support.

7. The cocker apparatus of claim 1, wherein the first bridge support and the second bridge support are substantially coaxial.

8. The cocker apparatus of claim 1, wherein the bridge support is adapted to contact and substantially locate the handle toward a proximal direction when the rope cocker is engaging the string in an operative configuration with the crossbow before cocking the string.

9. The cocker apparatus of claim 8, wherein the handle includes a longitudinal axis disposed substantially parallel with the bearing member rotation axis.

10. The cocker apparatus of claim 1, wherein an elongated hook portion is extending forward from a front surface of the body.

11. A rope cocker kit for cocking a string of a crossbow, the rope cocker kit comprising:

a rope;

a pair of handles sized and designed to be secured to respective ends of the rope; and a pair of string connectors sized and designed to be operatively secured by the rope between the pair of handles, each of the pair of string connectors comprising a body;

a rope-connecting portion;

a bearing member adapted to be rotatably secured to the body about an axle and a bearing member rotation axis thereof for supporting pressure and translational movements of the rope thereon;

a string-connecting portion including a non-rotatable bearing area for supporting translational movements of the string of the crossbow when cocking the crossbow; and a bridge support connected to the body for locating the handle in a user-receiving position when the rope cocker is in a position ready for cocking by a user.

12. The rope cocker kit of claim 11, wherein the body comprises an opening housing the first bearing member and receiving the rope therethrough, the bridge support extending over the opening.

13. The rope cocker kit of claim 11, wherein the bearing area includes polymer material.

14. The rope cocker kit of claim 11, wherein the bridge support is adjacent to the bearing member.

15. The rope cocker kit of claim 11, wherein the bridge support is substantially parallel to the bearing member rotation axis.

16. The rope cocker kit of claim 11, wherein the bridge support is a first bridge support and wherein the rope connecting portion further comprises a second bridge support.

17. The rope cocker kit of claim 11, wherein the first bridge support and the second bridge support are substantially coaxial.

18. The rope cocker kit of claim 11, wherein the bridge support is adapted to contact and substantially locate the handle toward a proximal direction when the rope cocker is engaging the string in an operative configuration with the crossbow before cocking the string.

19. The rope cocker kit of claim 18, wherein the handle includes a longitudinal axis disposed substantially parallel with the bearing member rotation axis.

20. A cocker apparatus for cocking a string of a crossbow, the cocker apparatus comprising:

a rope;

a pair of handles secured to respective ends of the rope; and a pair of string-receiving portions operatively secured by the rope between the pair of handles, each of the pair of string-receiving portions comprising a body including a polymer material;

a rope-connecting portion, disposed at a first end of the body, including a bearing member rotatably secured to the body for supporting translational movements of the rope thereon;

a string-connecting portion, disposed at a second end of the body, including a string-receiving area for temporarily securing the string of the crossbow when cocking the crossbow; and a support connected to the body for locating the handle in a user-receiving position when the rope cocker is in a position ready for cocking by a user.

* * * * *